US010161636B2

(12) United States Patent
Jenkins

(10) Patent No.: US 10,161,636 B2
(45) Date of Patent: Dec. 25, 2018

(54) TABLE TOP FIRE EFFECT ATTACHMENT

(71) Applicant: Bond Manufacturing Co., Inc., Antioch, CA (US)

(72) Inventor: Cameron Jenkins, Antioch, CA (US)

(73) Assignee: Bond Manufacturing Co., Inc., Antioch, CA (US)

( * ) Notice: Subject to any disclaimer, the term of this patent is extended or adjusted under 35 U.S.C. 154(b) by 111 days.

(21) Appl. No.: 15/191,181

(22) Filed: Jun. 23, 2016

(65) Prior Publication Data

US 2017/0350600 A1 Dec. 7, 2017

(30) Foreign Application Priority Data

Jun. 2, 2016 (CN) ..... 2016 2 0538740 U

(51) Int. Cl.
*F24B 1/181* (2006.01)
*F24B 1/199* (2006.01)
*F24C 3/00* (2006.01)

(52) U.S. Cl.
CPC ..... *F24B 1/181* (2013.01); *F24B 1/199* (2013.01); *F24C 3/006* (2013.01)

(58) Field of Classification Search
USPC ..... 126/26
See application file for complete search history.

(56) References Cited

U.S. PATENT DOCUMENTS 4,788,962 A * 12/1988 Mashburn ..... A47J 37/0713 126/25 R
6,626,090 B2 * 9/2003 McLemore ..... A47J 37/0786 126/26
6,769,906 B1 * 8/2004 Grove ..... F23D 14/28 126/519
8,602,017 B2 * 12/2013 May ..... A47J 37/0704 126/26
9,170,017 B2 * 10/2015 Shimek ..... F23C 7/004
2003/0188735 A1 * 10/2003 Yang ..... F24B 1/1808 126/519
2006/0236996 A1 * 10/2006 Mosher, II ..... F24B 3/00 126/30

OTHER PUBLICATIONS

TropitoneInstructions; https://www.tropitone.com/sites/default/files/page_files/r9tfiretable-fire-table-installation-and-operating-instructions-gas-031114.pdf; Published Mar. 11, 2014, Accessed Dec. 7, 2017.*

* cited by examiner

*Primary Examiner* — Gregory Huson
*Assistant Examiner* — Elizabeth M May
(74) *Attorney, Agent, or Firm* — Weide & Miller, Ltd.

(57) ABSTRACT

A fire effect device for holding, controlling and displaying fire and methods of attaching and mounting such a device to furniture, such as umbrella tables. The includes an internal chamber 11 which houses a fuel dispersion assembly 12 and a rigid hollow tube which may be mounted to the chamber or be of unitary construction with the chamber. The rigid hollow tube is designed to be inserted into a hole or aperture of a table, such as an umbrella hole, and connected to a gas valve and thereafter a fuel line or source, such as a propane tank. The device is attached and detached to the table with ease by i) engaging or disengaging the fuel line from the fire effect device and, ii) the simple turning of a nut.

16 Claims, 30 Drawing Sheets

TABLE TOP FIRE EFFECT ATTACHMENT

CROSS-REFERENCE TO RELATED APPLICATIONS

This application claims priority under 35 USC 119(a) to People's Republic of China Application No. 2016205387405 filed on Jun. 2, 2016, the disclosure of the prior application being incorporated herein in its entirety by reference in the disclosure of this application.

TECHNICAL FIELD

The present invention relates generally to devices for holding, controlling and displaying fire and, more particularly to methods of attaching such a device to furniture, such as tables and in particular tables having umbrella holes.

BACKGROUND

Fire pits, fire bowls and barbeques are types of fire effect devices that control fire within a contained space. Fire pits and bowls can be used as ornamental devices which display fire and/or provide heat to an indoor or outdoor space. Barbeques generally also include a grate or grill member to place food thereon and to cook the food. Attempts have been made to incorporate these kind of devices into or within a table top or other piece of furniture.

The prior art either provides i) tables with permanently attached heaters/fire bowl/grill which are too heavy and/or large and with limited means to remove the fire bowl/grill from the table, or ii) fire bowl/grills which can be placed on a table, but are not aesthetically pleasing or practical due to various pieces and parts required and the presence of connection tubes and other attachment parts that are not hidden.

For example, U.S. Pat. No. 6,065,466, issued to Baykal, discloses a combination patio table and outdoor barbeque where the table has an opening 16 within which a cooking griddle 23 is contained. Also contained within this opening is a bucket 24 being positioned underneath the table top 13 which includes venting ports 30 and a rimmed hole 31 to accommodate the pole of the umbrella or parasol. The opening 16 is much larger in size than the umbrella hole 31 in order to accommodate the large diameter of the bucket and griddle which rests upon the bucket. Venting ports are also placed on the frame (pedestal) of the table to accommodate a gas line when the gas fired burning feature is employed. This table requires a number of parts and/or design features which are often difficult to maintain, keep clean and can often be lost over time. Furthermore, the table itself must be specially designed to accommodate the barbeque. For example, the Baykal table must accommodate the size of bucket 24 and will not fit any other size barbeque.

Similarly, U.S. Pat. No. 6,769,906, issued to Grove et al., discloses a fire bowl 12 having pegs 16 which function as feet to be placed upon a table 18. Formed within the table is an enlarged centrally located hole 24 to place the fire bowl therein. Grove thus also requires a hole to be formed that accommodates the shape and size of the fire bowl placed therein. The fuel tank of Grove must be directly attached to the fire bowl whether on top of the table itself or suspended underneath the table with no support other than the fire bowl itself. This creates a dangerous situation with quite a heavy assembly being suspended in air and making movement of the table very difficult. Furthermore, the fuel tank and adjustment lever 50 take up space under the table and thereby restrict the leg movement of individuals sitting at the table. The Grove design also could not accommodate a larger tank size, such as a 20 pound propane tank, as all the aforementioned disadvantages mentioned would become even greater with a larger tank.

The present invention seeks to overcome these disadvantages by providing a unique attachment assembly between the fuel tank and the fire bowl which allows the tank to be separated from the fire bowl. Furthermore, it is desired to have the ability to use any size fuel tank in conjunction with a fire bowl, from one pound to twenty pounds or more, which would minimize the amount of times the tank must be replaced or refilled. Another desired feature of the present invention is to overcome the difficulty of accessing the propane tank and associated controls contained therein in the prior art. Oftentimes, additional steps for gaining access to the tank must be taken, such as moving the table or reaching into difficult to access spaces.

The fire receptacle of the present invention is easily attached, detached and reattached to a variety of tables having an umbrella hole, unlike prior art devices in this area which require a specialized table with an internal housing or a large cut out on a table to mount the fire device within the table. Umbrella tables are a common type of outdoor furniture which are readily available and can be inexpensive to purchase in comparison to the tables which are integrated with fire pits and/or bowls. Umbrella tables are used in households and commercial establishments alike for outdoor and indoor leisure. Incorporating the present invention with an umbrella table does not require any alteration of the table, nor does it require any additional pieces or elements to be purchased.

Furthermore, the particular mounting mechanism of the present invention is a feature unlike the prior art. The present invention facilitates the removal of the device in as little as two steps: i) the simple turning of a nut and ii) disconnecting the connecting hose from the fuel source. Other details and features of this receptacle are described in detail below and in the figures.

SUMMARY

In one general aspect, there is provided a fire effect device having a fire receptacle with an internal chamber, a bottom surface and at least one opening through the bottom surface, a fuel dispersion assembly having a substantially hollow enclosure having at least a first opening to allow a gas to exit the assembly and a second opening to allow gas to enter the assembly, wherein the second opening is in detachable connection with a gas valve, a rigid hollow tube having threading on its outside surface and being mounted to the bottom surface of the fire receptacle such that the hollow portion of the tube is aligned with the at least one opening of the fire receptacle, and a nut configured to mate with the outside surface of the hollow tube wherein the gas valve includes a gas outlet and gas inlet which may be detachably connected to a gas source.

Embodiments of the device may include one of the following features. The second opening of the hollow enclosure includes a tubular connecting segment which is substantially hollow and includes a first end, a second end and a tubular wall connecting the two ends having an aperture along the wall to allow air to enter the tubular connected segment. The tubular connecting segment and the fuel dispersion assembly may be of unitary construction. The hollow tube may be configured to be inserted into an opening on a table. The nut is used to secure the fire effect device to the table. The hollow tube may be mounted to the bottom surface of the fire receptacle by fasteners. The hollow tube may include a first end and a second end, with the first end having one or more openings configured to receive a fastener and the second end having an outer surface configured to receive a nut. The gas valve may include a knob in connection with a valve stem to control the flow of gas therethrough. The fire receptacle may be configured to rest on a surface of a table. The hollow tube may be rigid and have a diameter of from about 1 in. to about 1.9 in.

The second end of the tubular connecting segment may be threadably engagable with a first end of a hose, the hose being substantially hollow and having a first end and a second end, and the second end of the hose may be threadably engagable with a first end of the gas valve. Alternatively, the second end of the tubular connecting segment may be threadably engagable with a first end of the gas valve.

In another general aspect, there is provided a kit for providing a fire on a table top, including the fire effect device described above, and written or graphic instructions for use comprising the including the following steps: placing the fire effect device on a table top such that the rigid hollow tube is aligned with an opening of the table top, tightening the fire effect device to the table by engaging the nut with the rigid hollow tube; and, connecting the fire effect device to a gas source.

Embodiments of the kit may include one or more of the following features. The instructions may be provided in the form of an html address. One or more photographs or drawings depicting one or more steps of using the fire effect device may be included. The gas source may be a propane tank. The fire effect device may be detachable from the table top. The written or graphic instructions for use may further include the following steps for detaching the fire effect device from the table top: disengaging the nut from the rigid hollow tube such that the nut is separated from the rigid hollow tube, and disconnecting the fire effect device from the gas source. The opening of the table may be an umbrella hole. The written or graphic instructions for use may further include a step of turning on the gas source thereby allowing gas to be supplied to the fire effect device and/or adjusting the amount of gas supplied to the fire effect device.

DETAILED DESCRIPTION

Figure 1A:
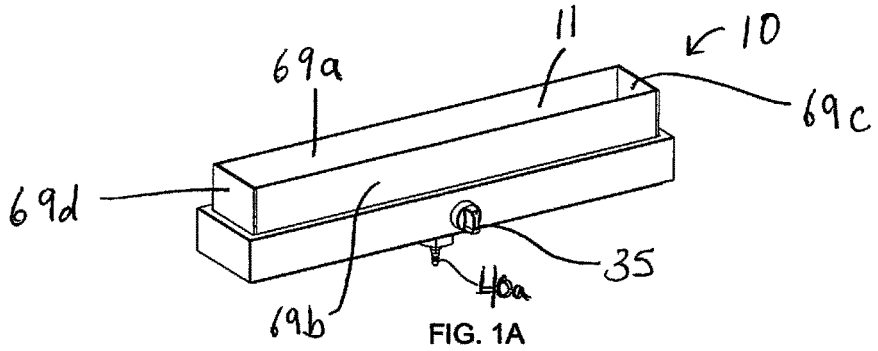
FIGS. 1A to 1G show several views of the fire receptacle 10 with extended glass walls and non-combustible rocks within the internal chamber.
Figure 1B:
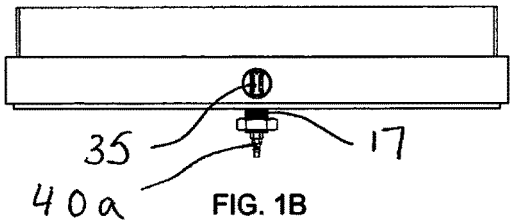
Figure 1C:
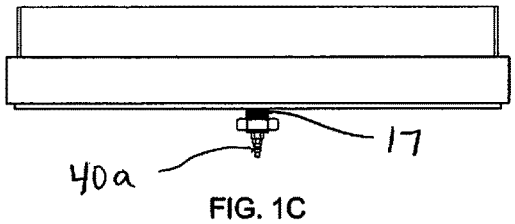
Figure 1D:
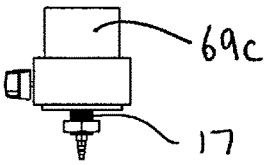
Figure 1E:
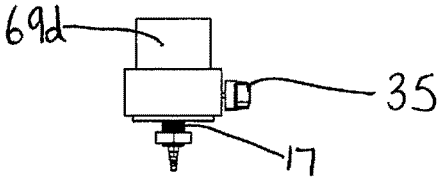
Figure 1F:
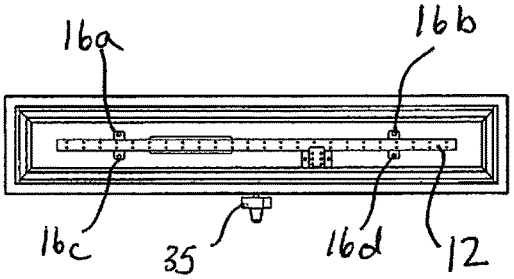
Figure 1G:
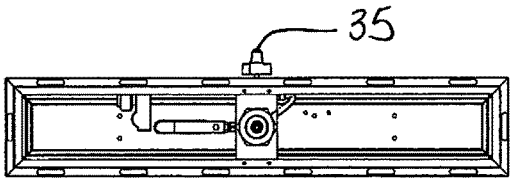

FIG. 1A shows a perspective view of the fire receptacle 10. Within the fire receptacle is internal chamber 11 which houses a fuel dispersion assembly 12. The fuel dispersion assembly may be an enclosure formed of any shape and most preferably is a metal pipe formed into a variety of different shapes, such as a straight rod (as is shown in FIG. 1F), a ring or a square, for example. The fuel dispersion assembly includes a plurality of holes 19*a-h* shown more clearly in FIG. 5, which function to direct the fuel or gas out of the assembly in the desired direction, which is preferably upwards or inwards (if the fuel dispersion assembly is a ring or square) so that when flames are produced, they are directed away from nearby objects or persons situated around the receptacle. A quick connect (also known as quick disconnect device or QDD) male fitting 40*a* is shown in FIGS. 1A-1E, which is extended through the rigid hollow tube 17. This male fitting 40*a* is designed to connect to a gas source having a female quick connect fitting 40*b*, as will be explained in more detail with respect to FIG. 7.

FIGS. 2A-2G are also provided and show the fire receptacle 10 having no walls, whereas the fire receptacle shown in FIGS. 1A to 1G include walls 69*a*, 69*b*, 69*c* and 69*d*. One or more walls may be provided to block the flame or sparks from escaping the perimeter of the fire receptacle 10 and therefore may serve a protective function to objects and persons in close proximity to the fire bowl. These walls may be constructed of frosted glass, clear glass, stone and any other suitable material.

FIGS. 3A to 3G depict an alternative embodiment of the fire receptacle of the invention, shown as 10*a*. Fire receptacle 10*a* includes a substantially rectangular base with side walls which project at an angle of greater than 90 degrees with respect to the flat rectangular base. These side walls form an internal chamber 11*a*. Fire receptacle 10*a* includes a plate 33 to partially deflect the flame from reaching a dangerous height and/or to prevent the flame from being extinguished by wind.

The fire receptacle of the invention may therefore take on a variety of shapes, such as those described above, or a bowl or square shape, and is not meant to limit the invention.

Figure 5:
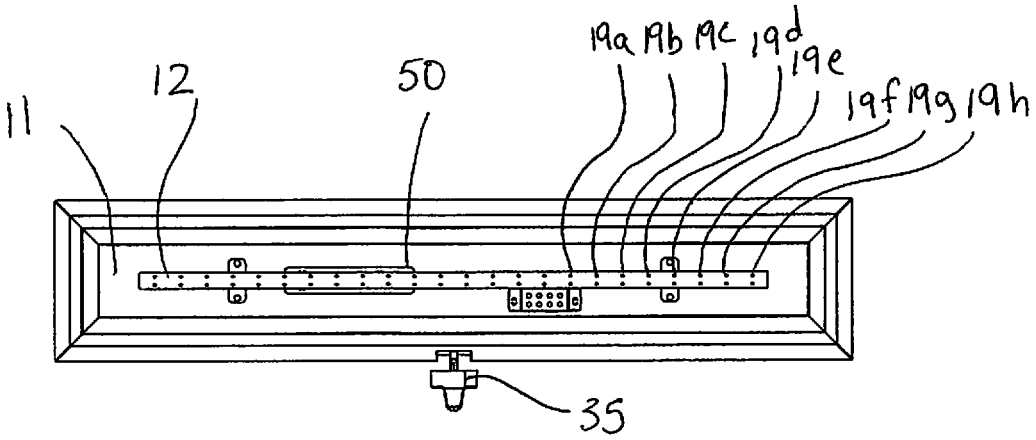
FIG. 5 shows a close up top view of the fuel dispersion assembly having a plurality of holes for fire to come through in the direction of the holes.

Shown in FIGS. 1F and 5 is the fuel dispersion assembly 12 which may be mounted on the floor or bottom surface of the internal chamber of the fire receptacle using one or more screws, 16*a*-16*d*. The fuel dispersion assembly may be mounted to any internal surface of the fire receptacle, such as the floor of the receptacle (as is shown) or the side walls of the receptacle. The surface of the dispersion assembly includes one or more holes 19*a*-*h*, shown in FIG. 5. The fuel dispersion assembly will include an opening or aperture such that the fuel dispersion assembly can be oriented to align with a venturi tube 50. A tubular connecting segment such as a flexible hose type tube is also provided with a first end being secured to an opening of the venturi tube 50, and the second end being secured to a gas valve or the fuel supply line or fuel source. The details of these connections will be explained further with reference to FIGS. 17-27.

The hollow rigid tube 17 is shown in more detail in FIGS. 11-15. FIGS. 11-15 show the hollow tube being threaded on its outside surface with a hollow region that extends the length of the tube, for example from the floor of the receptacle to the end of the tube. The hollow rigid tube 17 and fire receptacle 10 may be a unitary piece such that the tube is welded to the receptacle or permanently secured by other means. In another embodiment, the hollow rigid tube 17 may be mounted to the fire receptacle 10 by screws, for example. This embodiment is shown in more detail in FIGS. 17-48 and will be explained further below with reference to hollow rigid tube 163*b*, 263*b*, and 366. FIGS. 11-15 show one or more openings 46*a* and 46*b* along the length of the tube, as will be explained in more detail below. One advantage of the present invention is that the design is kept simple and clean with very few parts and steps needed to assemble the fire receptacle. The hollow rigid tube 17 may be included in the design of both fire receptacle 10 shown in FIGS. 1A-G and 2A-G, as well as fire receptacle 10*a* shown in FIGS. 3A-G.

Figure 7:
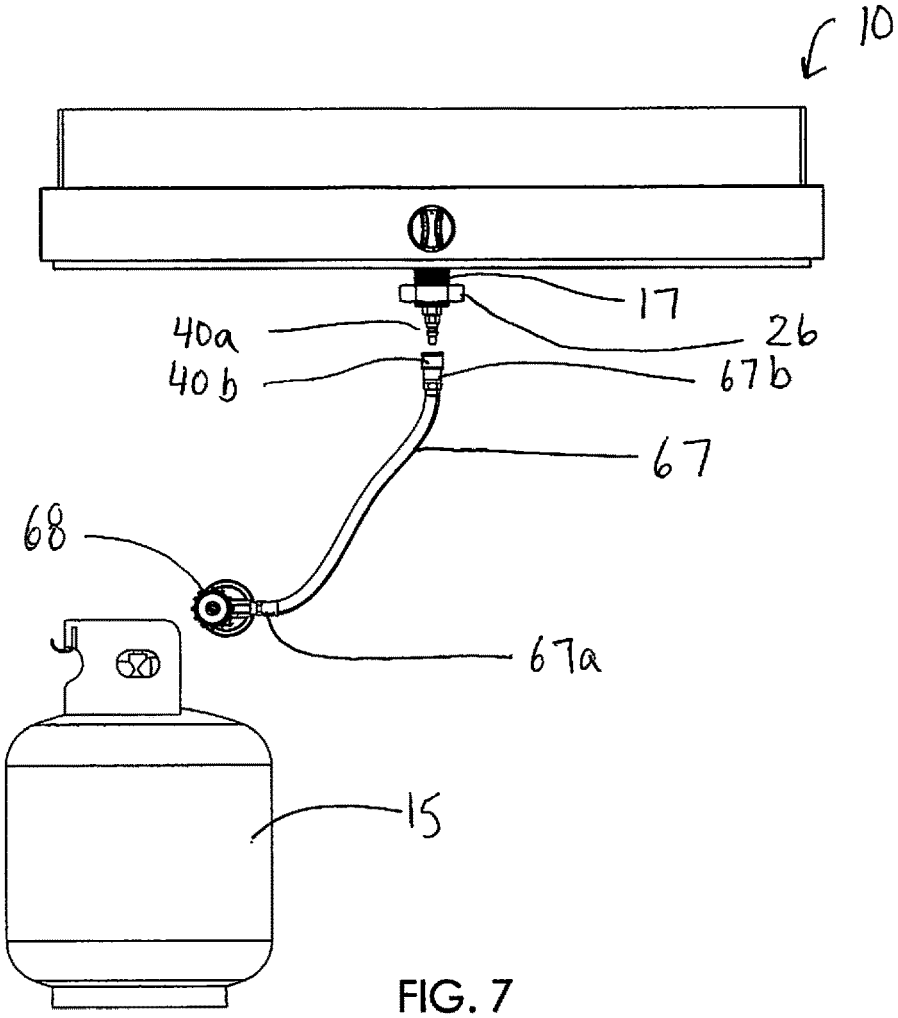

In practice, fuel enters the dispersion assembly from a fuel source 15, shown in FIG. 7. FIG. 7 is illustrative of the gas connection from any fire receptacle described in this application to a fuel source. To create the flame, a fuel source 15 is provided, which includes a fuel chamber having an outlet. FIG. 7 shows a flexible hose 67 which includes a gas inlet end 67*a* and a gas outlet end 67*b*. A connector handle 68 is provided to connect the gas tank to the hose 67. The gas tank includes an internal chamber and an outlet as is known in the art. The gas inlet end 67*a* of the flexible hose is configured to engage with the outlet of the gas tank to create a substantially airtight seal. The gas source is preferably a 5-20 lb propane gas cylinder.

Figure 8A:
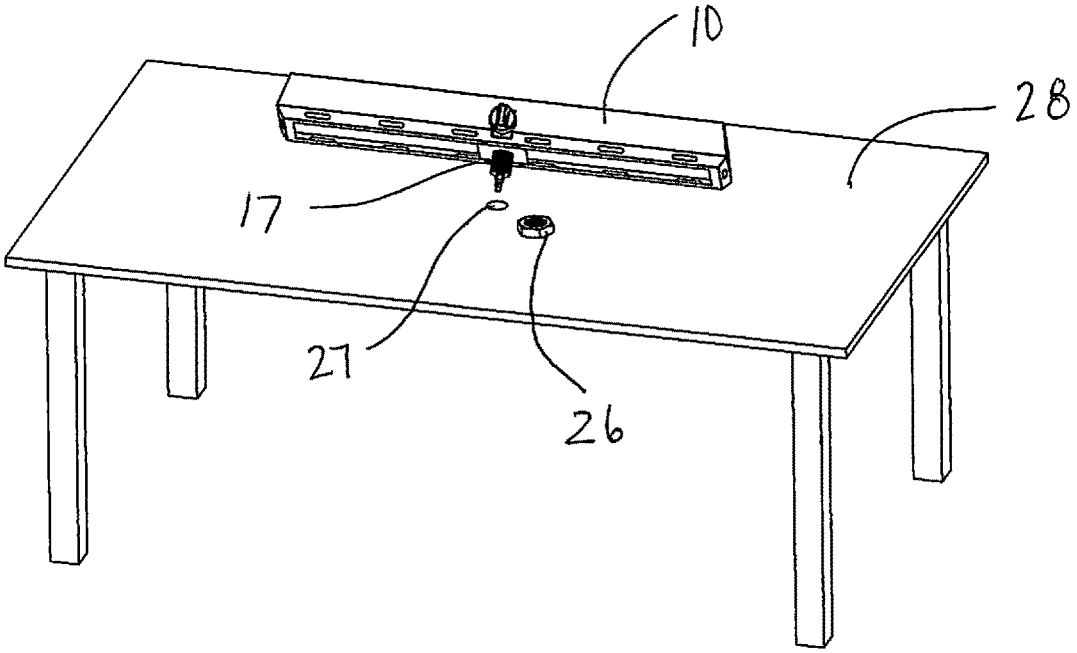
FIG. 8A shows a table having an umbrella hole and the underside of the fire receptacle having a hollow rigid tube on its underside.
Figure 8B:
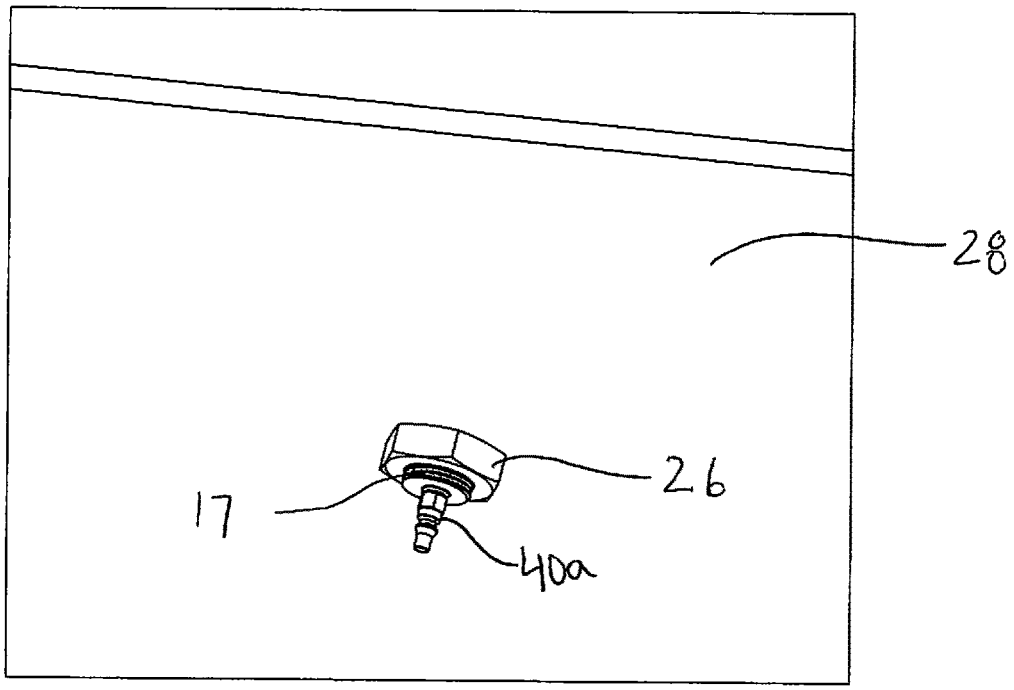
FIG. 8B provides a view of the underside of the table with the hollow rigid tube through the aperture of the table. A nut is used to securely mount the fire receptacle to the table.
Figure 9A:
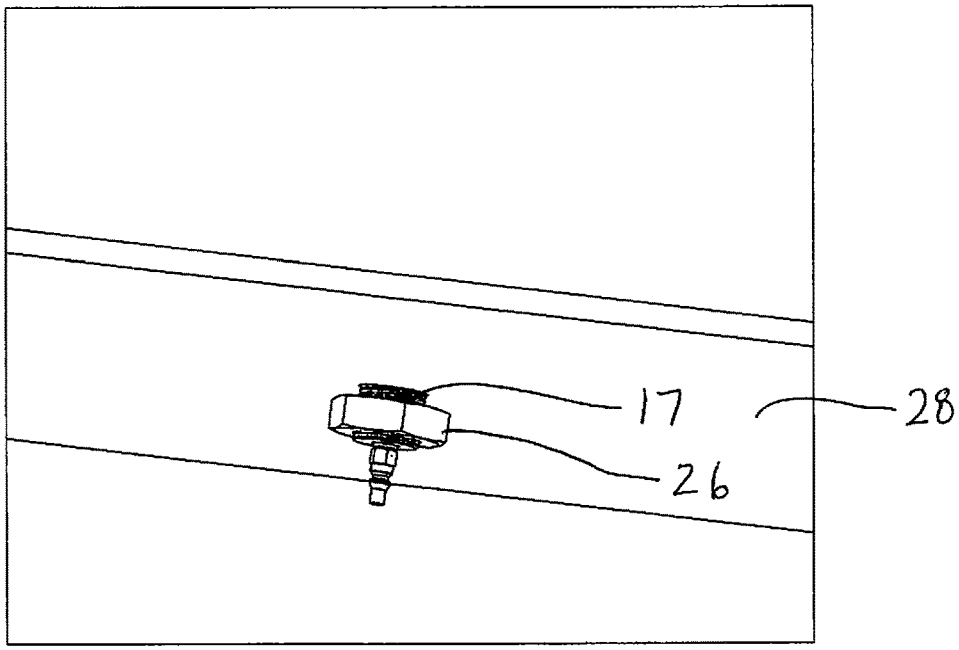
FIGS. 9A and 9B provide a view of the nut being threaded on the hollow rigid tube of the fire receptacle in order to securely mount the fire receptacle to the table.
Figure 9B:
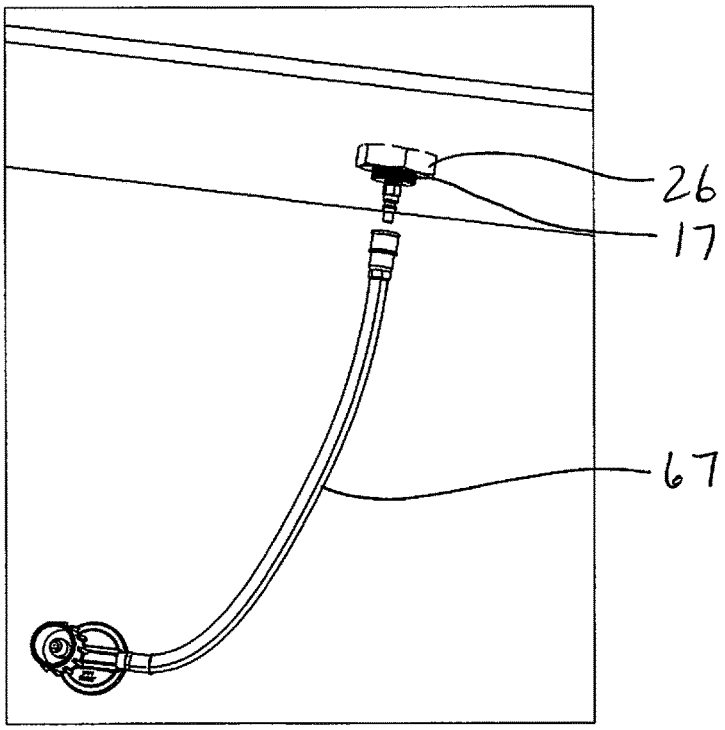

The diameter of the hollow tube 17 is preferably sized to line up with a standard umbrella hole of a patio table or umbrella table, such as a diameter of about 1 in. to about 1.9 in. FIG. 8A shows table 28 with umbrella hole 27. To secure the fire receptacle, the hollow tube 17 is inserted into the umbrella hole of the table and then a nut 26 is used to tighten the fire receptacle to the table by threadably engaging with the outer surface of the hollow tube 17. FIG. 8B is a view of the underside of the table 28 and shows the nut 26 secured to the hollow tube 17. The nut is tightened against the underside of the table 28. FIG. 9A shows the nut 26 secured to the hollow tube 17, but not tightened such that it is in contact with the underside of the table 28 as in FIG. 8B.

In this way, the fire receptacle of the present invention is easily attached to any standard table having an umbrella hole, unlike prior art devices in this area which require a specialized table with an internal housing or a large cut out on a table to mount the fire device within the table. The prior art either provides i) unitary products which combine the fire bowl/grill with limited means to remove the fire bowl/grill from the table, or ii) fire bowl/grills which can be placed on a table, but are not aesthetically pleasing or practical due to various pieces and parts required and the presence of connection tubes and other attachment parts that are not hidden.

Depending on the length of the flexible hose 67, the gas tank can be hidden in a rolling compartment and placed to the side of the table and used as an additional counter space for the user. Alternatively, if there is a gas line nearby, the tubular connecting segment may be attached to the gas line itself instead of a stand alone tank. This attachment mechanism accommodates a variety of different sized tanks, from one pound to twenty pounds or more.

Figure 10:
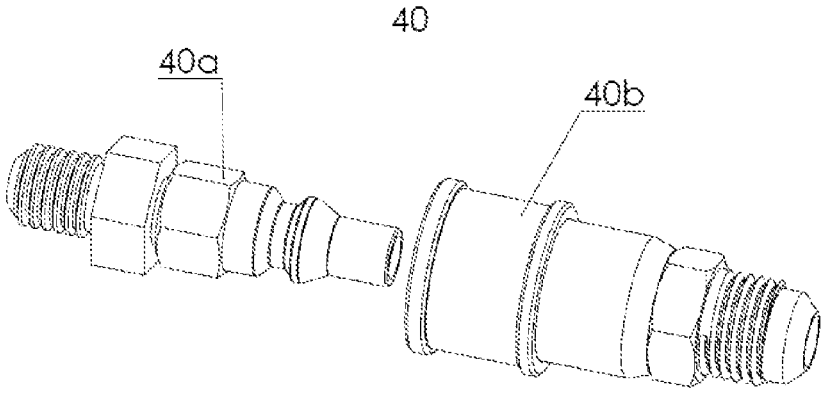
FIG. 10 provides a close up view of quick connect fitting 40.
Figure 11:
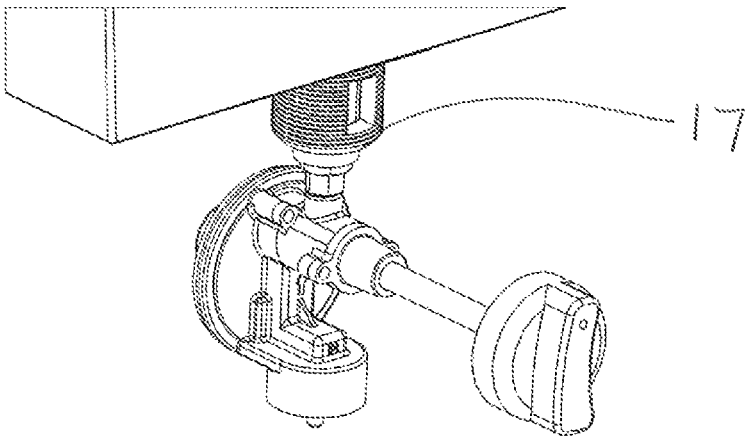
FIGS. 11-15 show a close up view of an embodiment of the invention which uses an adjustable valve assembly to control the amount of fuel entering the fuel dispersion assembly 12.
Figure 12:
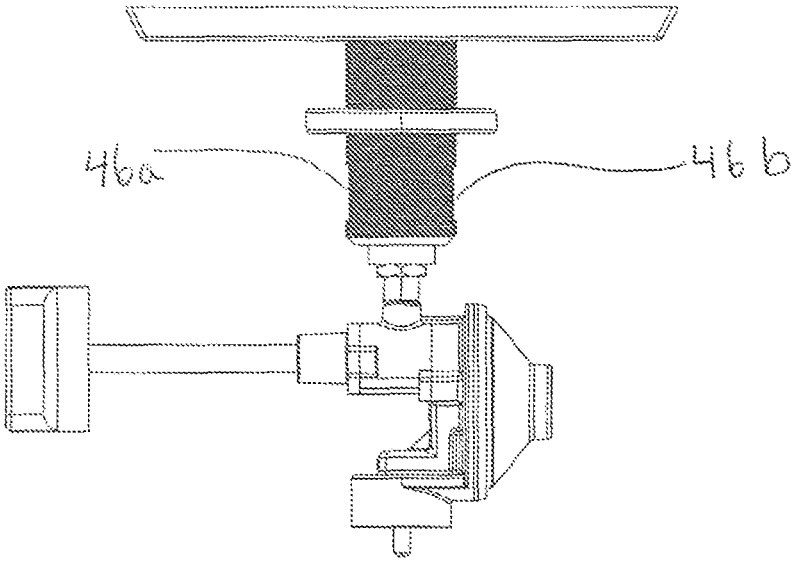
Figure 13:
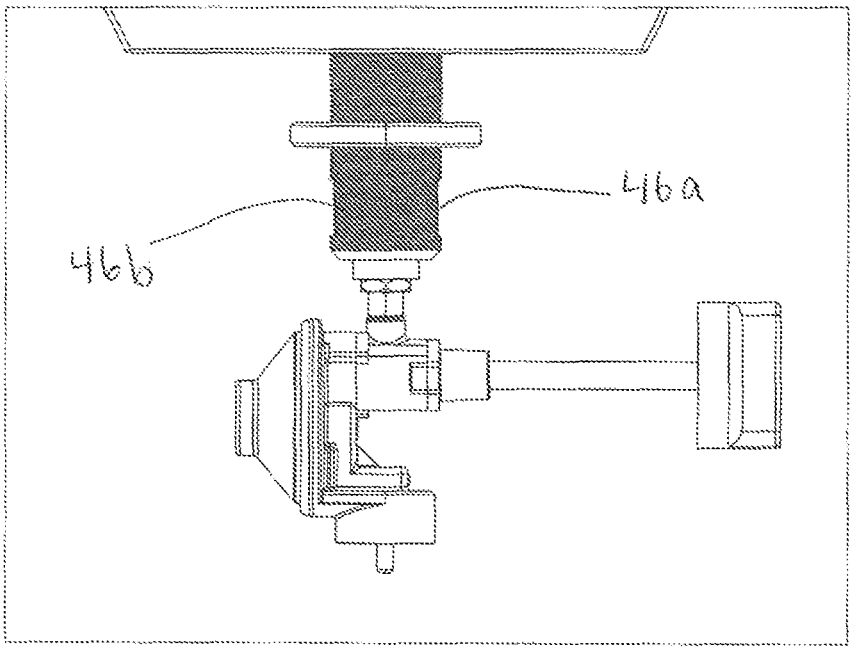
Figure 14:
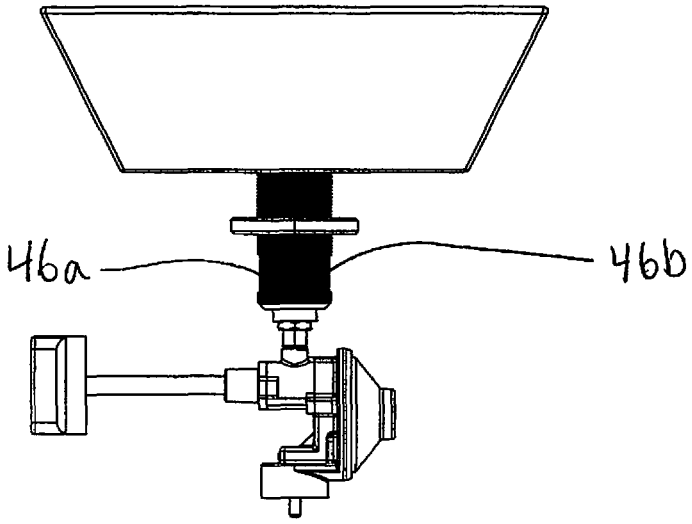
Figure 15:
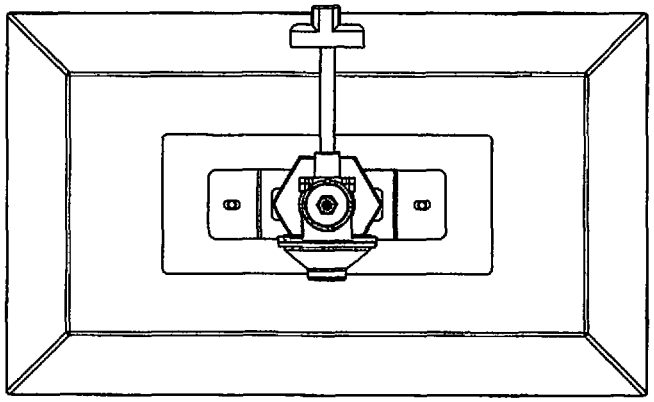

The fire receptacle of the present invention is a removable device which can be attached, detached and reattached to a variety of different tables. The device can be removed in two steps—i) disconnecting the male quick connect fitting 40*a* from the female quick connect fitting 40*b* located at an end of the flexible hose 67, and ii) the simple turning of the nut 26. The fire receptacle can be re-attached and connected to a gas line by employing similar steps. That is, inserting the hollow tube 17 into the umbrella hole of a table and securing the receptacle by engaging the nut 26 with the outer surface of the tube, and then connecting male quick connect fitting 40*a* to female quick connect fitting 40*b*. FIG. 10 provides an example of quick connect fitting 40 with the male end 40*a* and female end 40*b*. The male end is designed to fit within female end 40*b* when in an engaged state. FIG. 10 also shows the threaded end of 40*b* which is meant to be in direct connection with a gas hose or gas line 67.

The mounting mechanism described herein allows the mounting of the present fire effect receptacle to mount to a variety of different types of furniture. For example, the receptacle is easily mounted to any table having an umbrella hole that is constructed out of a heat safe material, such as a metal or wooden table. The fire receptacle can also be lined or covered in an insulating material to facilitate use of the receptacle on plastic furniture or to simply provide an additional layer of heat protection. An insulating bowl or dish could be used, for example.

It is envisioned that this type of mounting mechanism can be used with any kind of existing furniture, even without a preexisting umbrella hole. Given that the diameter of the hollow tube 17 can be quite small, it is possible to integrate this fire effect receptacle into any furniture either having a preexisting hole or capable of forming a small hole through one of its surfaces.

After the receptacle is mounted on a table and the fuel line is connected via the connection of quick connect fitting pieces 40*a* and 40*b*, the fire effect receptacle may be turned "on" by turning on the fuel source, turning the integrated knob 35 to the "on" position, and thereafter providing a spark at a point near to the fuel dispersion assembly such as by lighting a match or lighter. The size of the flame can be controlled by turning the integrated knob which internally restricts and allows the flow of gas to the fuel dispersion assembly.

The flame may appear to burn above the noncombustible media, such as pebbles, stones, rocks, sand, or glass, which is located within the internal chamber of the receptacle. This creates a pleasing effect and can therefore be used ornamentally.

Figure 2A:
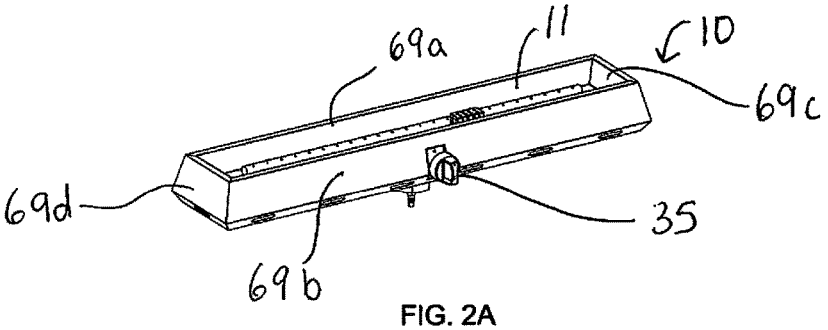
FIGS. 2A to 2G show several views of the fire receptacle with several openings placed along its bottom edge to help allow fumes to exit the device.
Figure 2B:
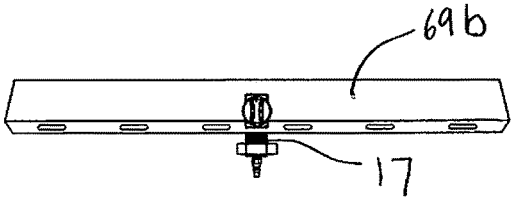
Figure 2C:
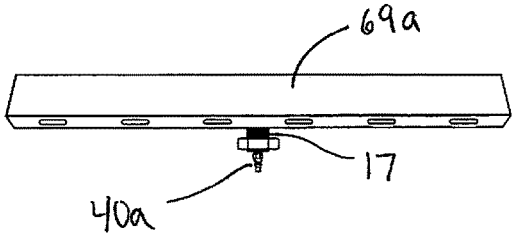
Figure 2D:
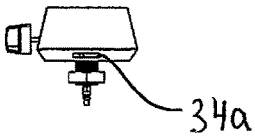
Figure 2E:
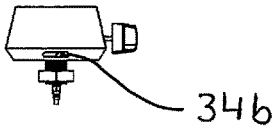
Figure 2F:
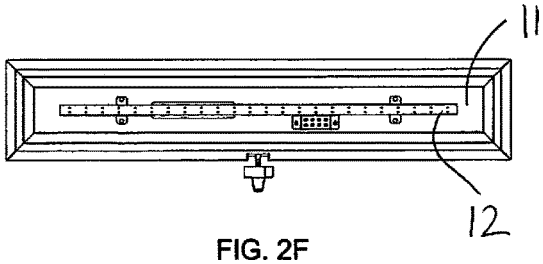
Figure 2G:
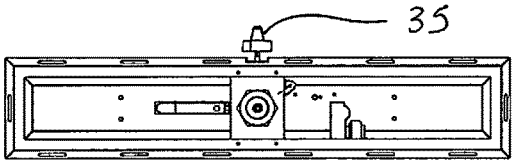
Figure 6:
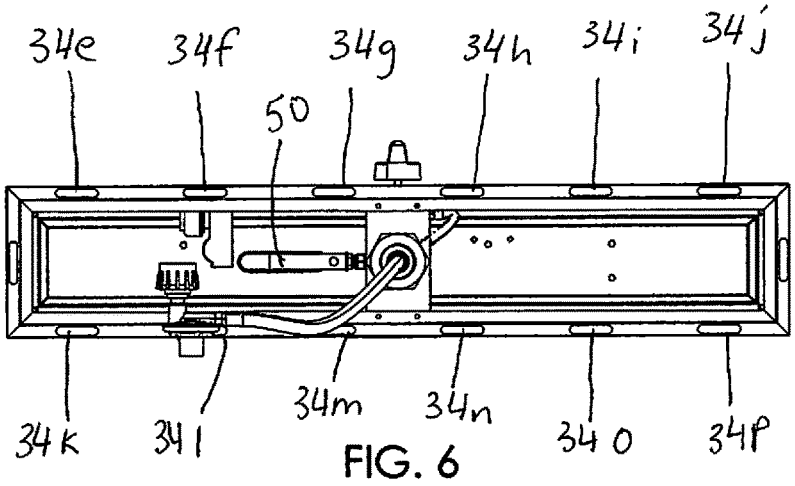
FIGS. 6 and 7 show the connection between the fuel dispersion assembly and a fuel tank or chamber.

Ventilation slots 34 *a* and *b* are provided on the outside side walls of the receptacle as shown in FIGS. 2D and 2E. Other ventilation slots are shown on side walls 69*a* and 69*b*. FIG. 6 also shows ventilation slots 34*e-p* on the bottom outside surface of the receptacle. These slots serve to bring in outside air prior to combustion of the fuel and also to allow smoke to exit the internal chamber of the receptacle as a safety precaution. The addition of outside air to the propane line produces a cleaner and more efficient flame, thereby avoiding a smoky, orange flame which can be more of a nuisance than a pleasure to the surrounding area.

Figure 3A:
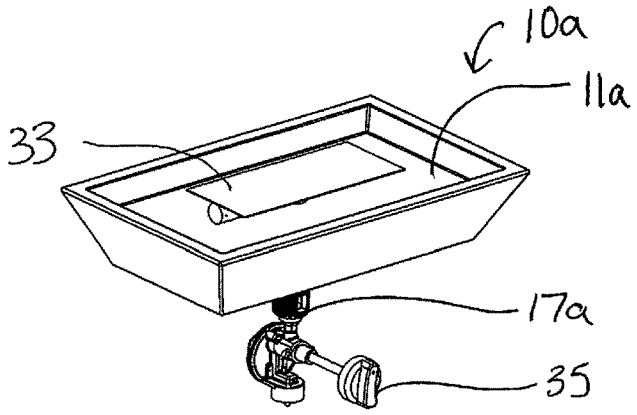
FIGS. 3A to 3G show several views of a fire receptacle 10*a* in a third embodiment having an adjustable valve assembly to control the amount of fuel entering the fuel dispersion assembly 12.
Figure 3B:
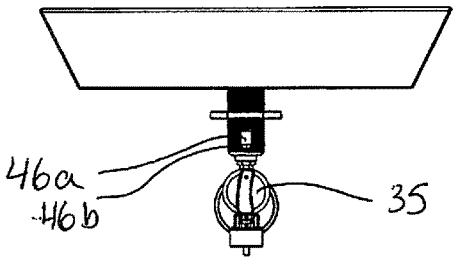
Figure 3C:
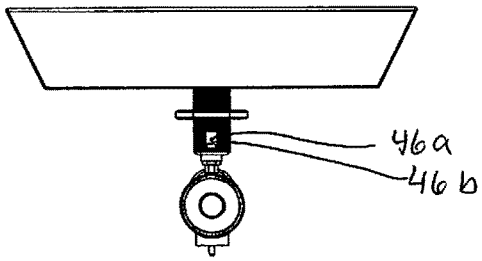
Figure 3D:
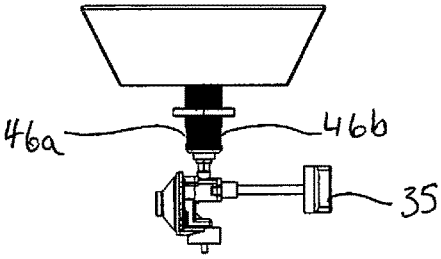
Figure 3E:
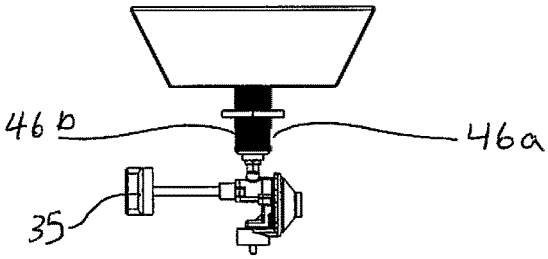
Figure 3F:
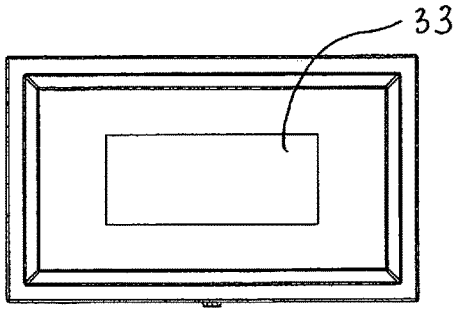
Figure 3G:
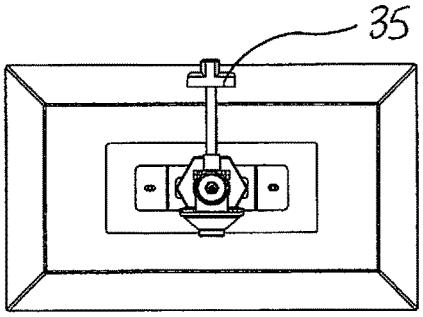
Figure 4:
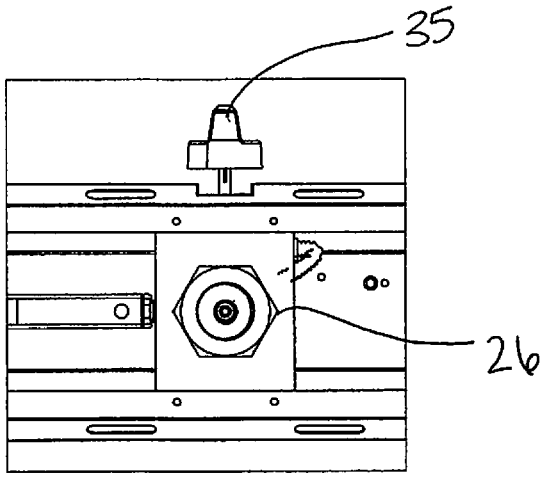
FIG. 4 shows a close up bottom view of the fire receptacle 10.

In one embodiment, a plate 33 may be placed on top of the fuel dispersion assembly to partially deflect the flame from reaching a dangerous height and/or for preventing the flame from being extinguished by wind. The addition of a plate may be an important safety feature of the fire receptacle, as shown in FIGS. 3A and 3F.

Figure 16:
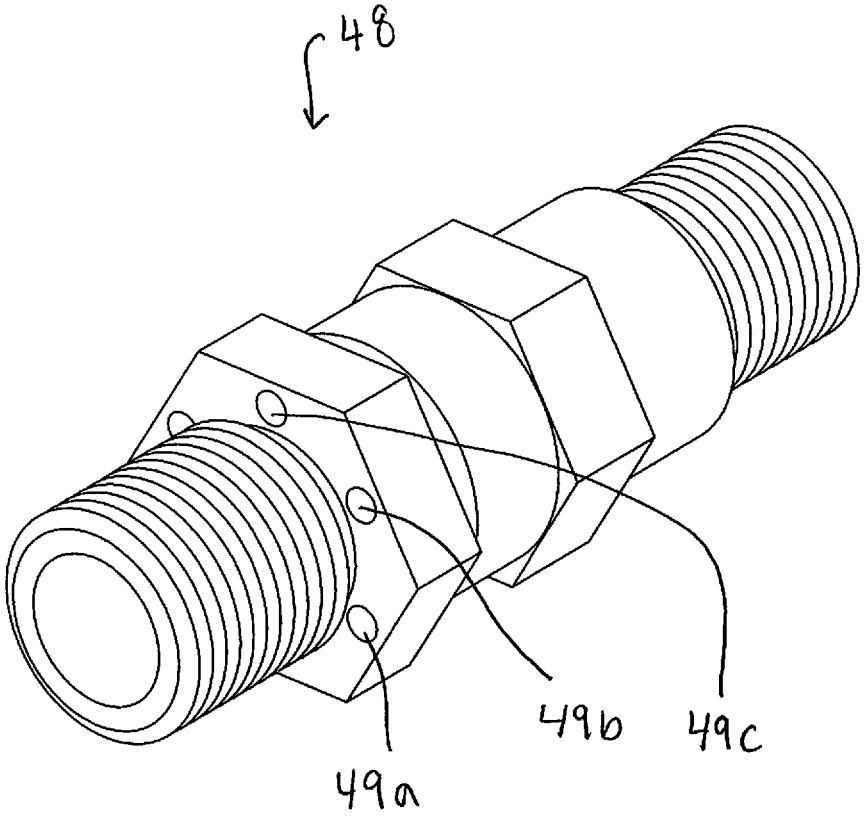
FIG. 16 provides a view of an air mixer which may be incorporated into the fire effect receptacle.

An air mixing feature may be incorporated into the receptacle and above-mentioned gas connections in order achieve an optimal flame when using propane gas as the fuel source, for example. The air mixing feature brings in air through openings 46*a* and 46*b*, shown in FIGS. 11-14, and allows air to combine with the propane before it travels up through the hollow tube. The addition of outside air to the propane line produces a cleaner and more efficient flame, thereby avoiding a smoky, orange flame which can be more of a nuisance than a pleasure to the surrounding area. FIG. 16 depicts another embodiment where an air mixer 48 is provided and may be connected at any point along the fuel supply line shown in FIGS. 1-15 to incorporate air into the fuel supply which ultimately reaches the fuel dispersion assembly 12. Openings 49*a*, 49*b* and 49*c* are shown which allow air to enter the fuel supply line.

Shown in FIGS. 11-15 is a close-up view of an embodiment of the invention using an adjustable valve assembly to control the amount of fuel entering the fuel dispersion assembly 12. This embodiment is provided in greater detail in FIGS. 34-48 and will be discussed in detail later on in this application.

Figure 17:
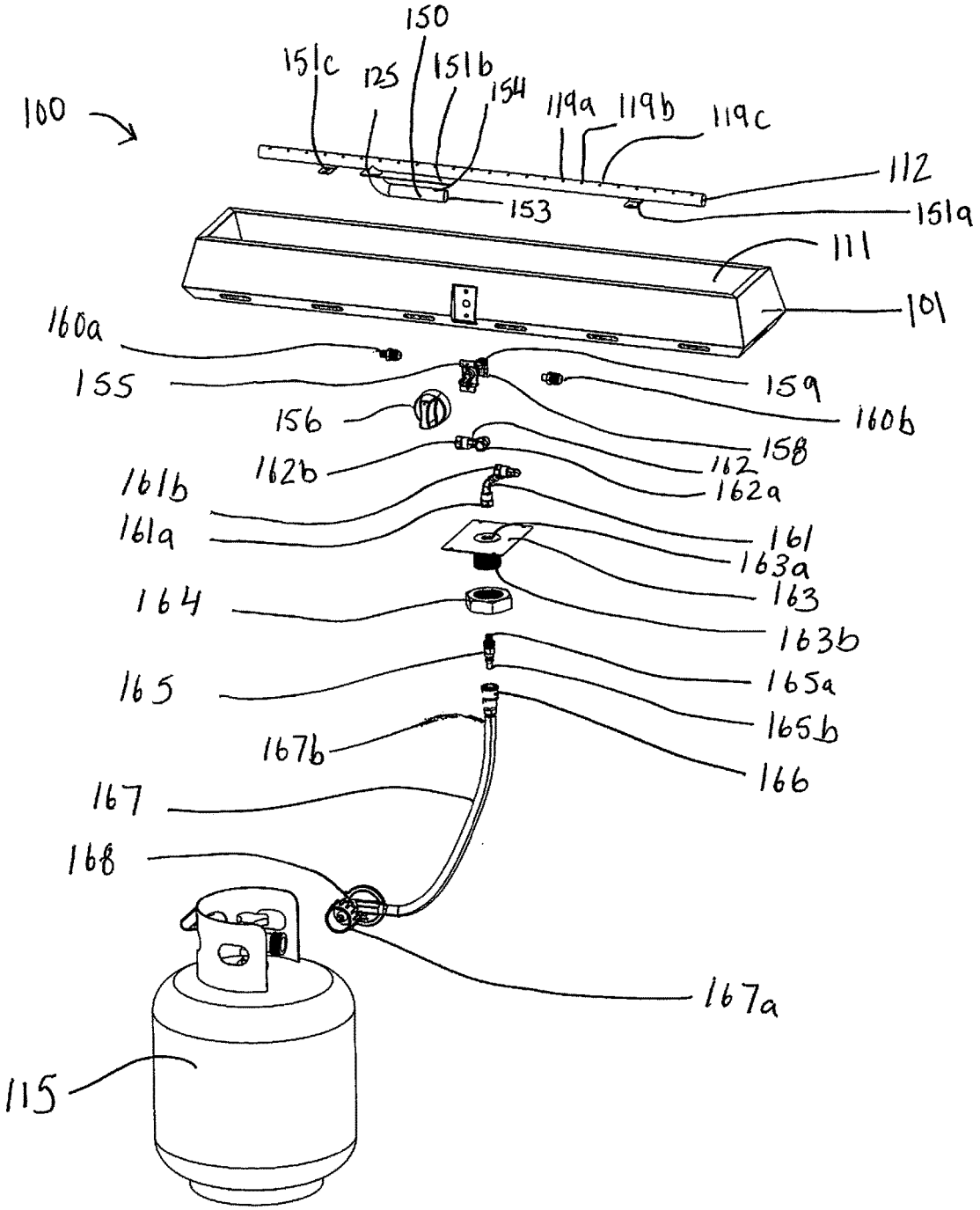
FIG. 17 is an exploded view of an alternative embodiment of the invention with fire receptacle 100 which includes gas valve 155, a bent venturi tube 150, and mounting plate 163.

FIGS. 17-27 are provided as an alternative embodiment of the inventive fire receptacle. Fire receptacle 100 is substantially rectangular in shape but it is envisioned that the receptacle may take on a variety of shapes such as circular, oval, triangular or square. Within the fire receptacle is internal chamber 111 which houses a fuel dispersion assembly 112. The fuel dispersion assembly may be a metal pipe formed into a variety of different shapes, such as a straight line or rod, a ring or a square, for example. The fuel dispersion assembly includes a plurality of openings 119*a-c* which function to direct the fuel in the desired direction, which is preferably upwards or sideways such that the flame is directed away from nearby objects or persons situated around the receptacle. Shown in FIG. 17 is a fuel dispersion assembly in the form of a hollow and rigid rod.

The fuel dispersion assembly 112 includes one or more feet 151 which are designed to be in contact with the floor of the internal chamber 111 in order to stabilize and position the fuel dispersion assembly in a substantially upright manner such that holes 119 are oriented sideways facing or upwards facing. Shown in FIG. 17 are feet 151*a*, 151*b*, and 151*c* located at three spaced apart locations along the length of the rod and mounted (such as welded) to the bottom outside surface of the rod. The fuel dispersion assembly 112 is preferably hollow to allow for the flow of air and gas within and up through holes 119.

The inlet or aperture 125 is shown in FIG. 17 to be at the bottom surface of the rod and may be positioned anywhere along the length of the rod. At the location anywhere along the length of the fuel dispersion assembly, there is a tubular connecting segment attached or mounted, such as venturi tube 150. For example, the venturi tube 150 may be mounted by welding to the fuel dispersion assembly at point 125. This creates an open interior space between the fuel dispersion assembly and the venturi tube 150 to allow gas to travel there through. The venturi tube 150 may extend in a substantially downward or substantially sideways (parallel to the length of the fuel dispersion assembly) direction and includes tube inlet 153. The venturi tube has an opening or gap 154 which serves to allow air to enter the tube and mix with fuel/gas to provide the flame when a spark is ignited.

Figure 18:
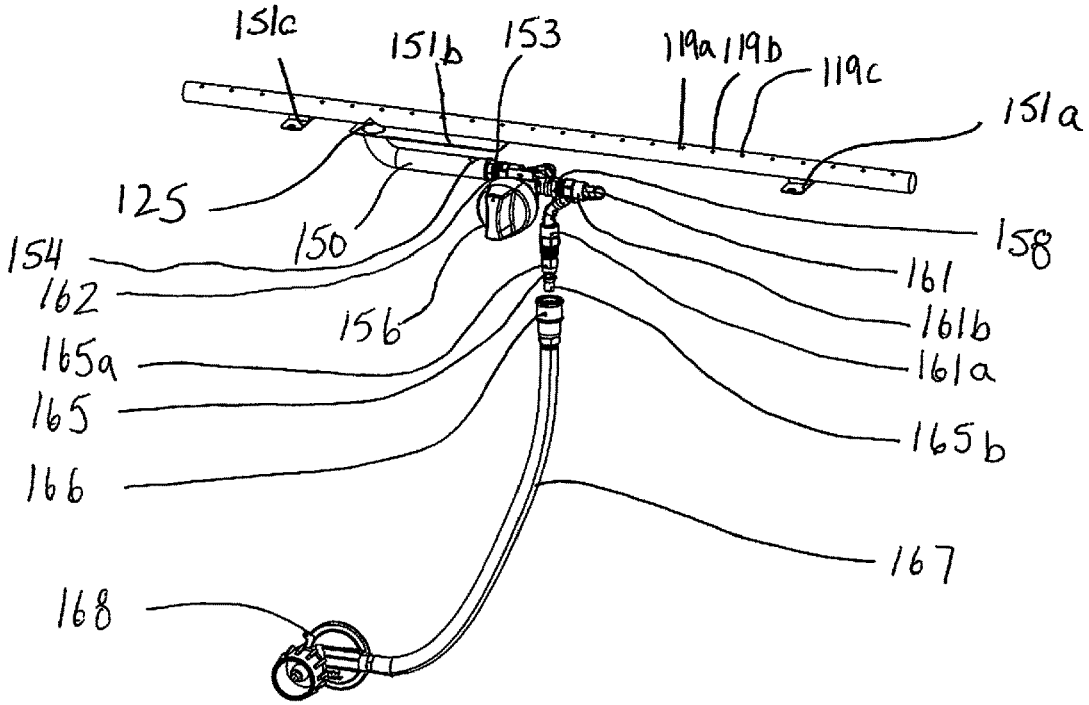
FIGS. 18-21 are several views of the fire receptacle 100 showing the interior components.

The venturi tube inlet 153 is in removable connection with gas valve 155. FIG. 18 shows the connection of the gas valve to the tube inlet 153. The gas valve 155 may be in the form of a ball valve, butterfly valve, gate valve, needle valve or other type of valve as is known in the art to precisely actuate gas flow control. The control knob 156 is attached to the gas valve 155 in a manner as is known in the art, such as by pressure fitting into the valve stem 157. When the control knob 156 is pushed in and turned towards the open position, the valve stem actuates the gas valve to allow the flow of gas to enter the venturi tube through inlet 153. In one embodiment, the turning of the knob may ignite a spark which would produce a flame when combined with the gas or fuel flowing through the venturi tube, through aperture 125, into hollow rod 112 and out through one or more holes 119. In another embodiment, the fuel flows in the manner just described and a spark is provided by the user by igniting a match or lighter and holding it close to the one or more holes 119, for example.

As explained earlier, the control valve regulates the gas flow to the internal chamber 111. These valves may have a spring loaded locking feature designed to lock into place when the valve is in the OFF position. The valve may be depressed by pushing in the control knob while turning to the ON position.

The gas valve 155 includes a fuel inlet 158 and outlet 159 which is in connection with venturi tube inlet 153. The fuel inlet 158 of the gas valve may be threadably connected to flexible inlet pipe 161. The fuel outlet 159 may be threadably connected to a flexible outlet pipe 162. The flexible inlet pipe 161 is substantially hollow on the inside and has two ends, a gas inlet end, 161*a* and a gas outlet end 161*b*. The flexible outlet pipe 162 has two ends, a gas inlet end, 162*a* and a gas outlet end 162*b*. The gas outlet end 162*b* is preferably threadably fastened to the fuel inlet 153 of the venturi tube. The gas inlet end 162*a* of the flexible outlet pipe 162 is preferably threadably fastened to gas outlet 159 of the gas valve 155. The gas outlet end 161*b* of the flexible inlet pipe 161 is preferably threadably fastened to the gas inlet 158 of the gas valve 155. The gas inlet end 161*a* of the flexible inlet pipe 161 is preferably brought through mounting plate 163, mounting nut 164, and is engaged with quick connecting fitting 165 which includes a first end 165*a* and a second end 165*b*. The mounting plate preferably includes a mounting end 163*a* and a rigid hollow tube threaded end 163*b*. The flexible inlet pipe 161 and outlet pipe 162 may be constructed of any kind of metal material, such as stainless steel, copper, aluminum or an alloy thereof.

Shown in FIG. 17 is the gas inlet end 161*a* being capable of being threadably fastened or engaged with the first end of the quick connect fitting 165. The quick connect fitting 165 is a male fitting which is configured to be inserted into and engaged with the female quick connect fitting 166. The female quick connect fitting 166 is attached to flexible hose 167 which includes a gas inlet end 167*a* and a gas outlet end 167*b*. A connector handle 168 is provided to connect the gas tank or other fuel source to the hose 167. The gas tank 115 includes an internal chamber and an outlet as is known in the art. The gas inlet end 167*a* of the flexible hose is configured to engage with the outlet of the gas tank 115 to create a substantially airtight seal. The gas source is preferably a 5-20 lb propane gas cylinder.

An injector 160*a* or other type of connector shown as 160*b* may be used at various places in the assembly, including as a connecting piece between the gas valve inlet 158 and the outlet end 161*b* as shown in FIG. 17, or between gas valve outlet 159 and flexible outlet pipe 162.

Figure 19:
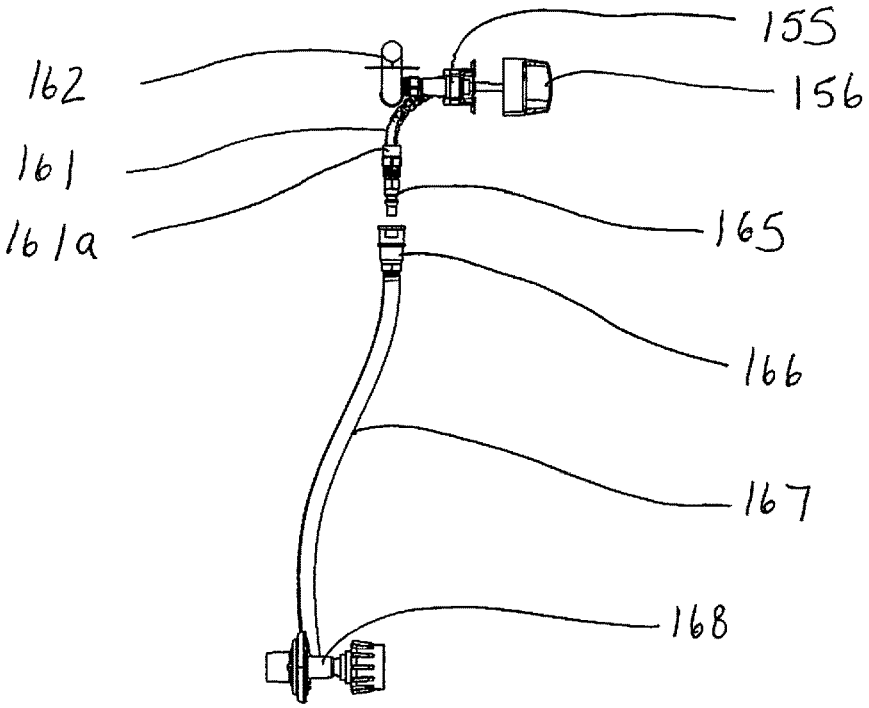
Figure 20:
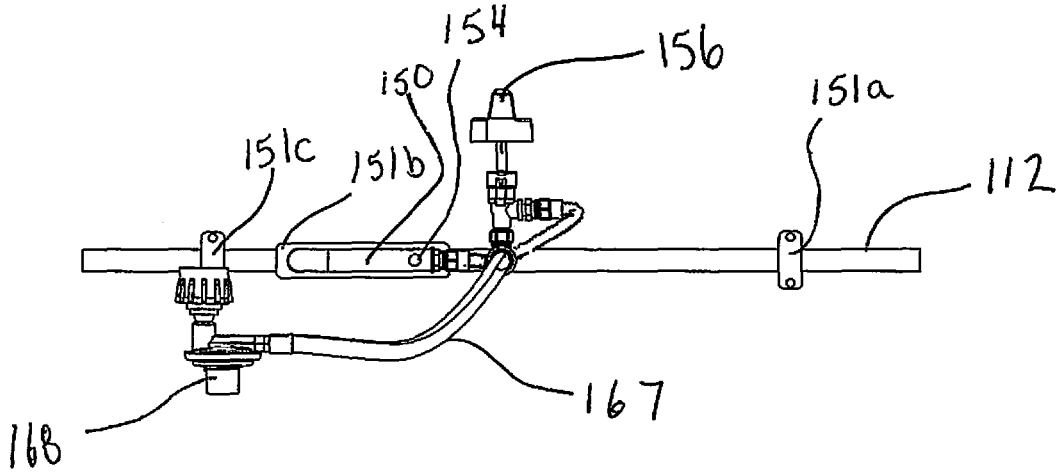
Figure 21:
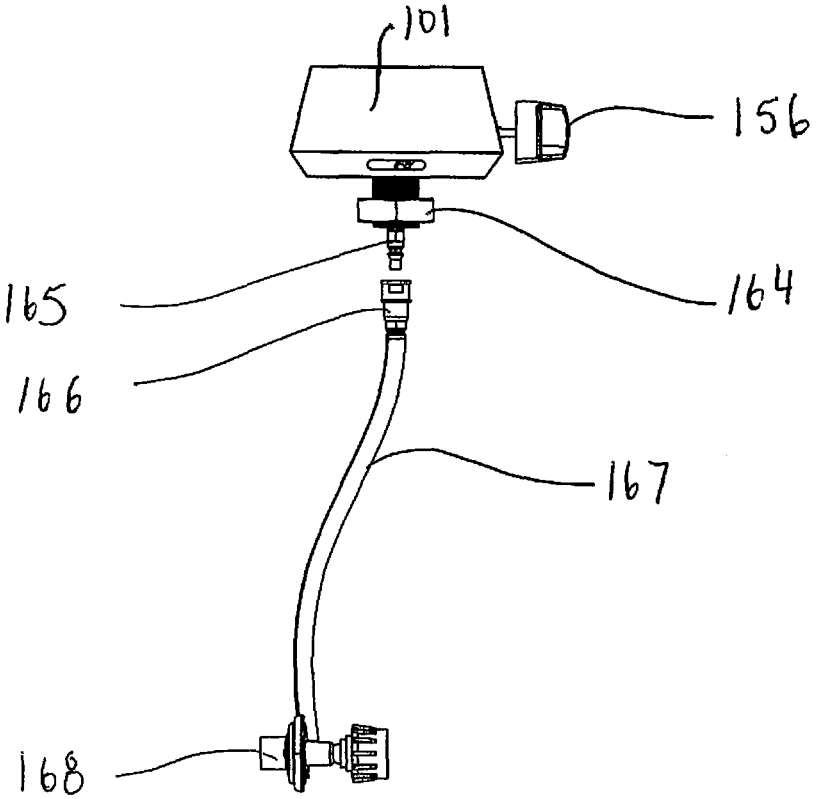
Figure 22:
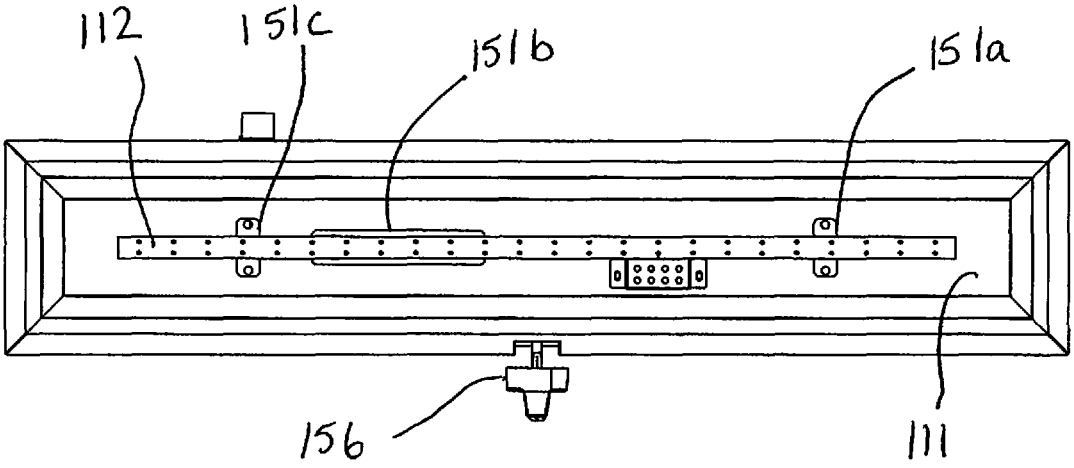
FIG. 22 is a top view of the fire receptacle 100.
Figure 23:
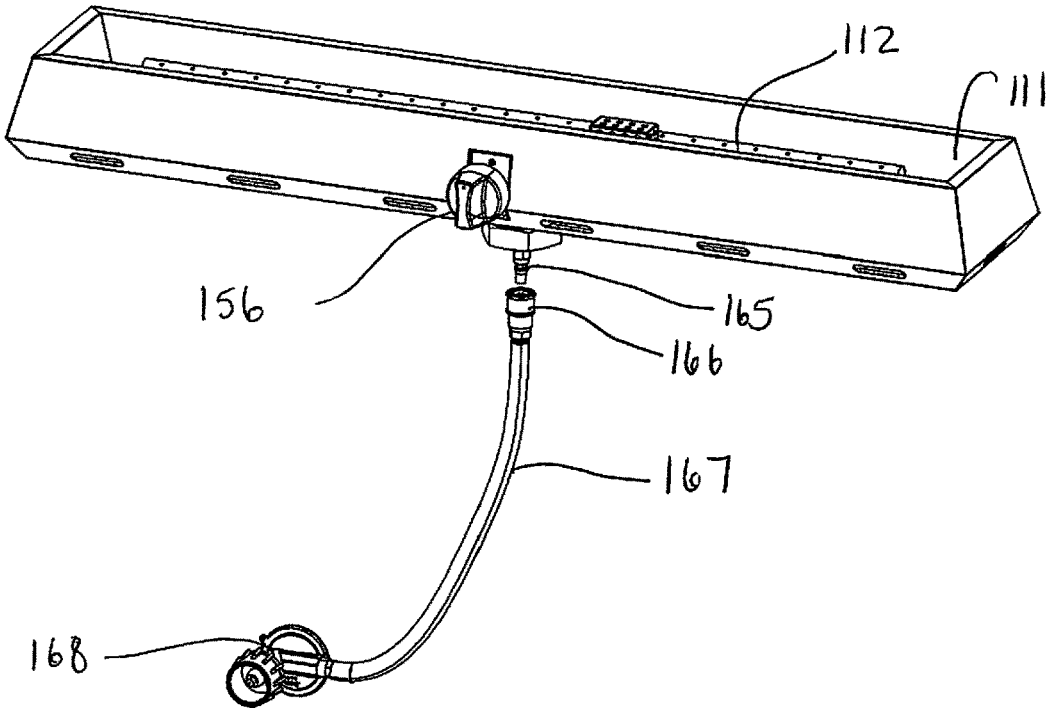
FIG. 23 is a perspective view of the fire receptacle 100.
Figure 24:
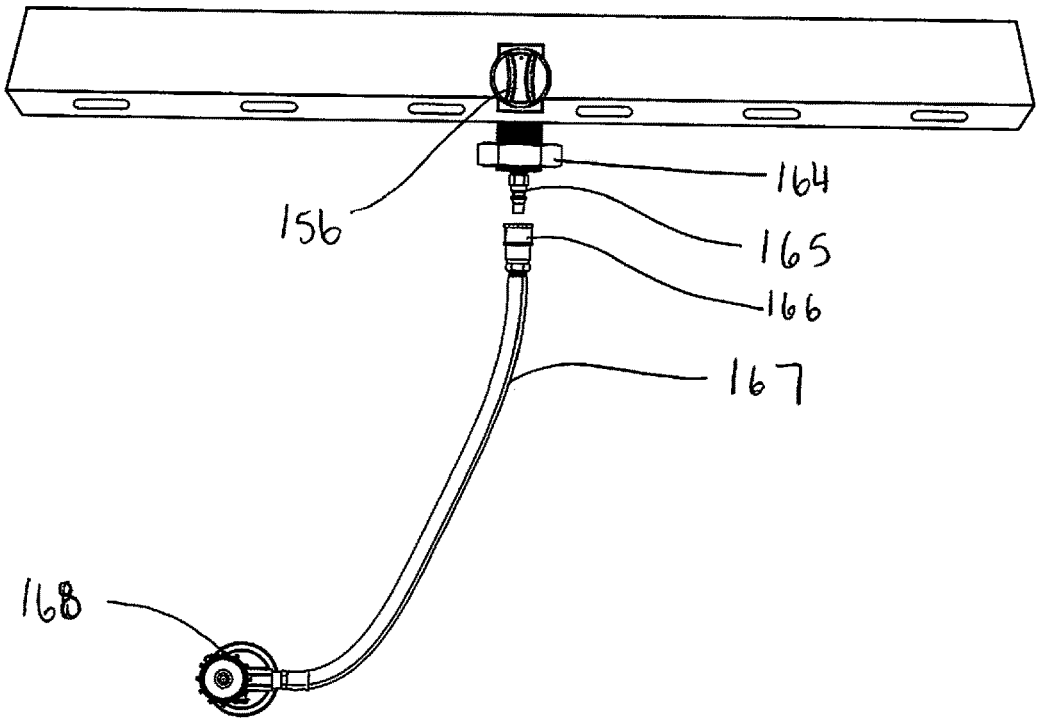
FIG. 24 is a front view of the fire receptacle 100.
Figure 25:
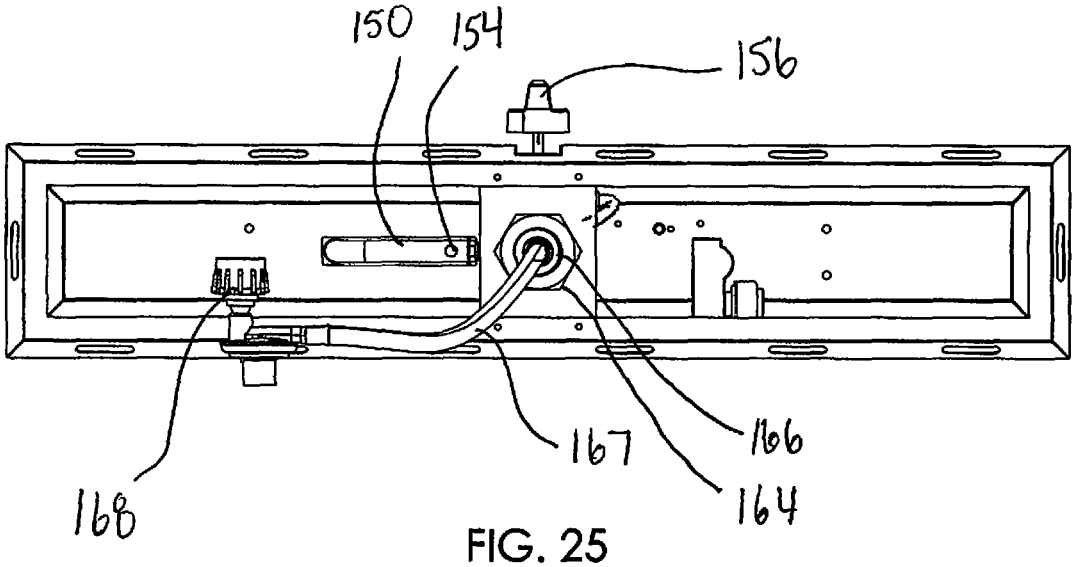
FIG. 25 is a bottom view of the fire receptacle 100.

FIGS. 18-20 is a perspective view, side view, and bottom view of the assembly shown in FIG. 17 with most of the pieces being assembled, except for the container 101 having internal chamber 111.

Each of the above-mentioned pieces making up the fire receptacle 100 and gas connection assembly is preferably pre-assembled as is shown in FIGS. 18-25, such that during use, the only steps required are to i) position the fire receptacle on the top surface of a table 170*a* such that the rigid hollow tube threaded end 163*b* of the mounting plate can be brought through the umbrella hole 127 of the patio table, ii) secure the mounting nut 164 to the rigid hollow tube threaded end 163*b* such that the fire receptacle is secured to the table, and iii) connect the female quick connect fitting 166 to the male quick connect fitting 165 as is known to one of ordinary skill in the art, such as tightening the two fittings together. This procedure allows the fire receptacle to be quickly and efficiently secured to the table and the gas line to be quickly and easily connected to the fire receptacle.

Figure 26:
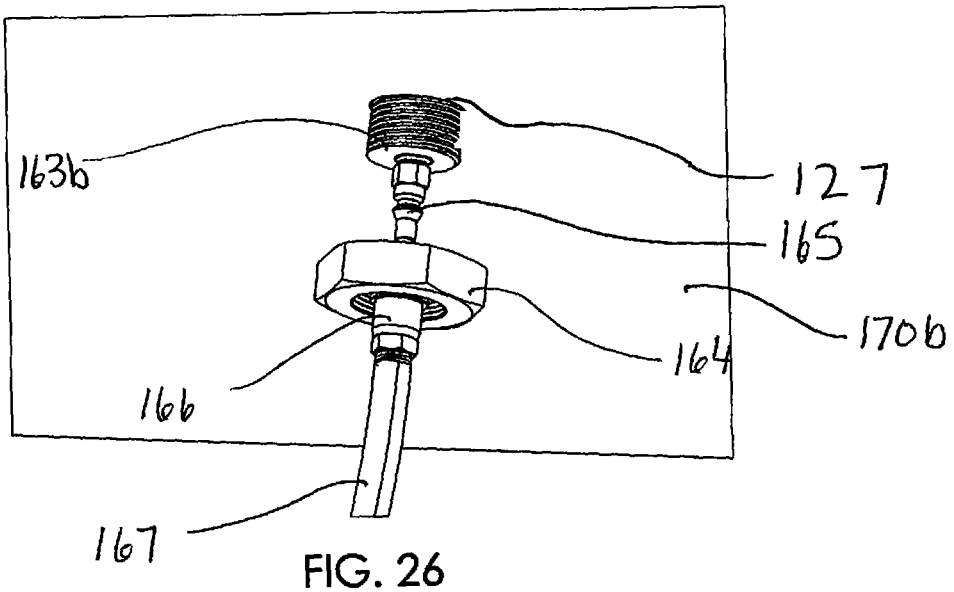
FIGS. 26 and 27 depict the method of inserting the fire receptacle 100 into a table having an opening and securing the fire receptacle to the table.

FIG. 26 shows the underside 170*b* of a patio table having umbrella hole 127 and the rigid hollow tube threaded end 163*b* of the mounting plate positioned within the umbrella hole. The mounting end 163*a* is preferably a rigid piece which is secured to the underside of the fire receptacle 100. The mounting end 163*a* may be screwed into or welded on the underside of the fire receptacle, for example. The mounting end is preferably a flat piece that is welded to the rigid hollow tube threaded end 163*b*, with the threaded end being substantially tubular in shape with threading on its outside service. The threaded end may be hollow and is preferably welded to the mounting end such that the mounting end and the threaded end form one unitary piece.

Figure 27:
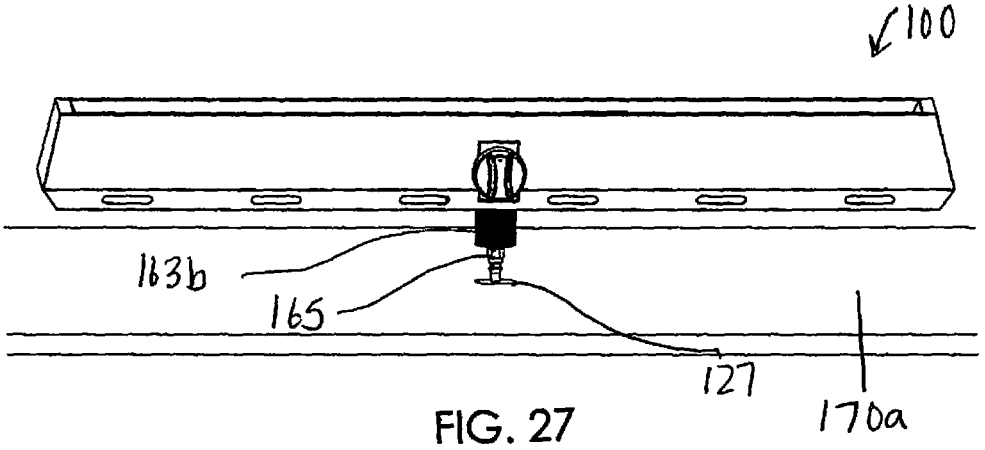
Figure 28:
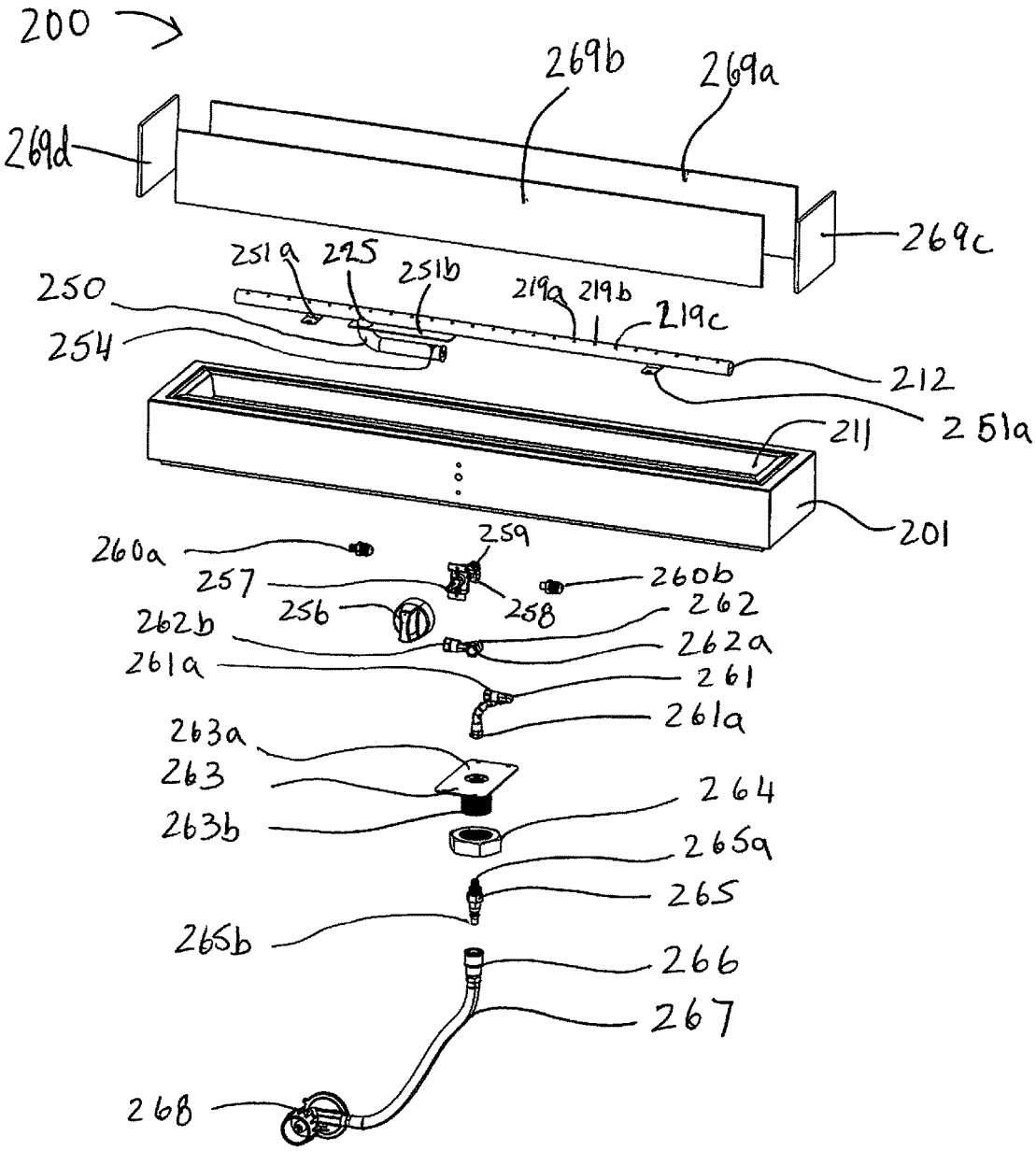
FIGS. 28-33 depict an alternative embodiment of the invention with fire receptacle 200 which includes walls to deflect flames or sparks within the internal chamber 211 of the receptacle.
Figure 29:
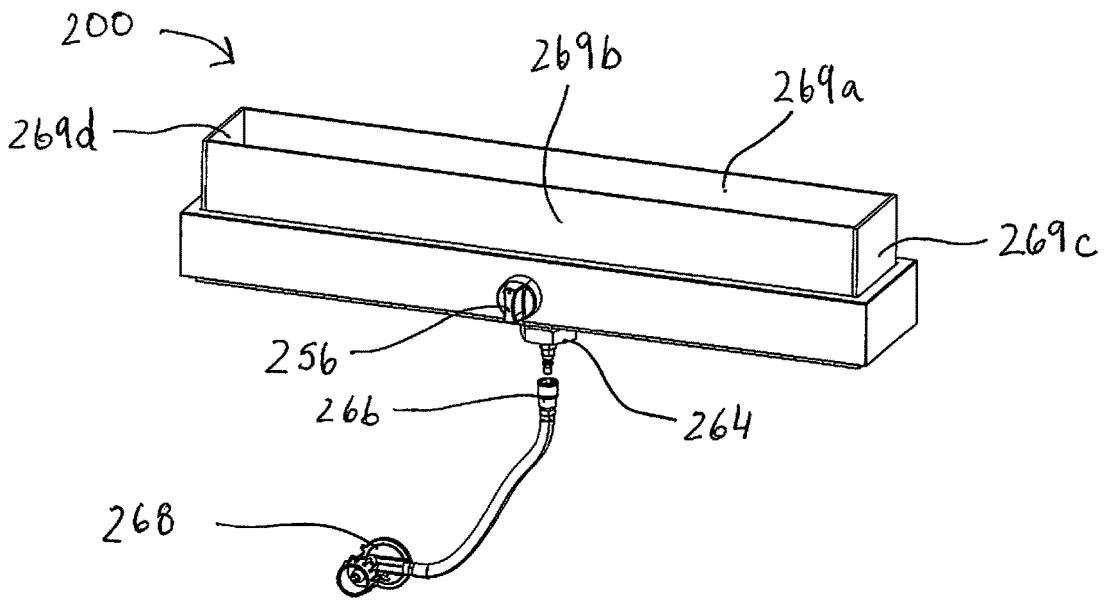
Figure 30:
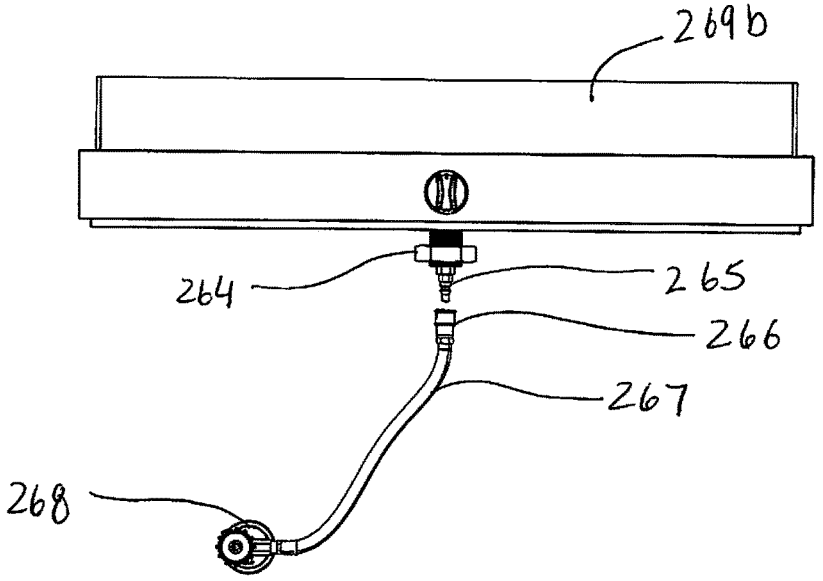
Figure 31:
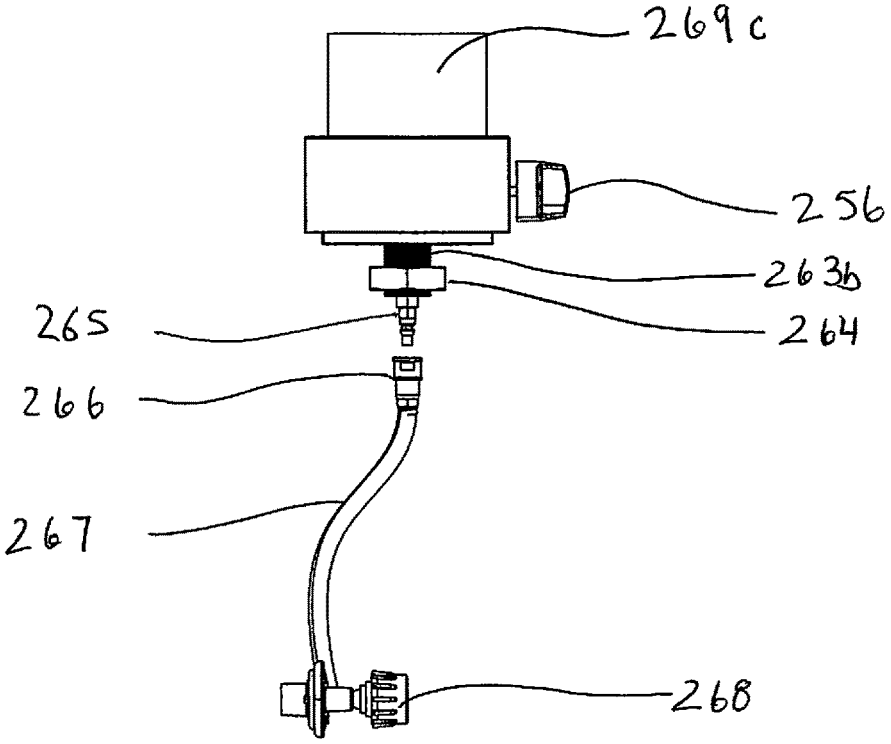
Figure 32:
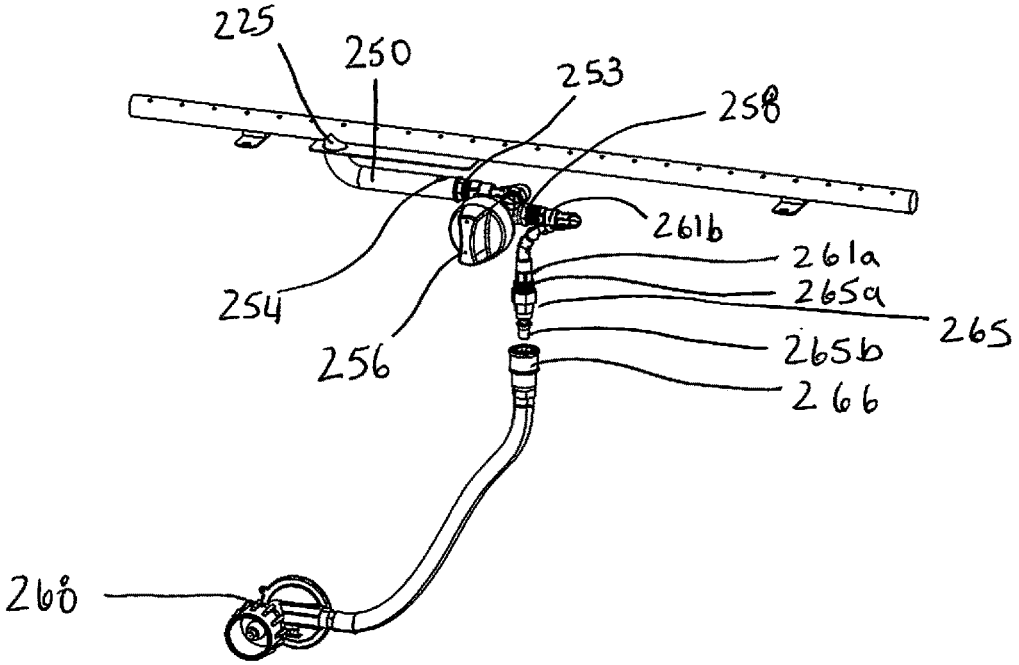

FIG. 27 shows a partial bottom view of the fire receptacle 100 with rigid hollow tube threaded end of the mounting plate 163 being inserted into umbrella hole 127. The top surface 170*a* of the table is also shown and can be formed of a variety of materials such as wood, wood composite or aluminum, for example. In use, the fire receptacle 100 is preconnected to elements 112, 150, and 155-165, with the mounting nut threaded on the rigid hollow tube threaded end of the mounting plate. Elements 166, 167 and 168 are also kept assembled and connected to a gas source such that when a user wishes to use the fire receptacle, he simply connects the female quick connect fitting 166 to the male fitting 165 and secures the fire receptacle to a table using the mounting nut. The quick connect fitting is shown in more detail in FIG. 10 as element 40.

In an alternative embodiment, the fire receptacle can be used without the mounting plate on any secure flat surface.

FIGS. 28-32 depict an alternative embodiment of the invention. Fire receptacle 200 includes removal side walls 269 *a, b, c* and *d*. These walls may be constructed of frosted glass, clear glass, stone, and any other suitable material. The walls may serve to block the flame or sparks from escaping the perimeter of the fire receptacle 200 and therefore may serve a protective function to objects and persons in close proximity to the fire receptacle.

The gas connection assembly of the alternative embodiment described in FIGS. 28-32 is similar to the assembly described with respect to FIGS. 17-25. In use, the user may turn his gas source on by turning the knob 256. The gas then flows from the gas tank through the flexible hose 267, then through flexible inlet metal pipe 261, then through flexible outlet metal pipe 262, next through venturi tube 250 opening 225 and is then dispersed within hollow rod 212 and out through one or more openings 219 *a, b* and *c*. The gas inlet end 261*a* of the flexible inlet metal pipe 261 is preferably pre-fitted to the first end of the quick connect fitting 265. When the user desires to use fire receptacle 200, he may connect the quick connect fitting 265 to the quick connect fitting 266 and simply turn on the regulator knob. The quick connect fitting 265 is a male fitting which is configured to be inserted into female quick connect fitting 266. The female quick connect fitting 266 is attached to flexible hose 267 and a connector handle 268 may connect to a fuel source 15 such as a gas tank or other fuel source, as is shown in FIG. 7.

Figure 33:
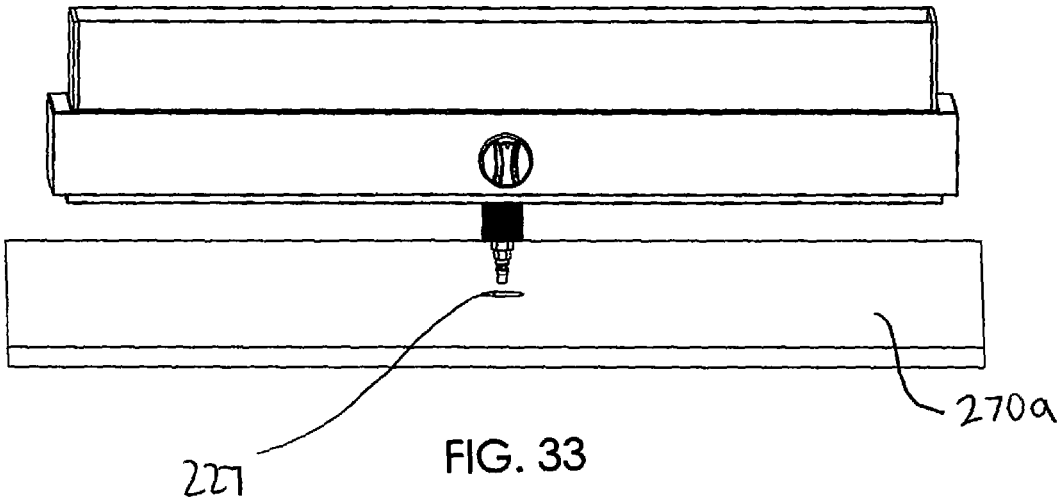

FIG. 33 depicts the fire receptacle 200 being inserted into umbrella hole 227 on a table top surface 270*a*. This process is performed in the same manner as described with respect to fire receptacle 100 shown in FIGS. 17-25. The gas source is preferably a 5-20 lb propane gas cylinder.

Figure 34:
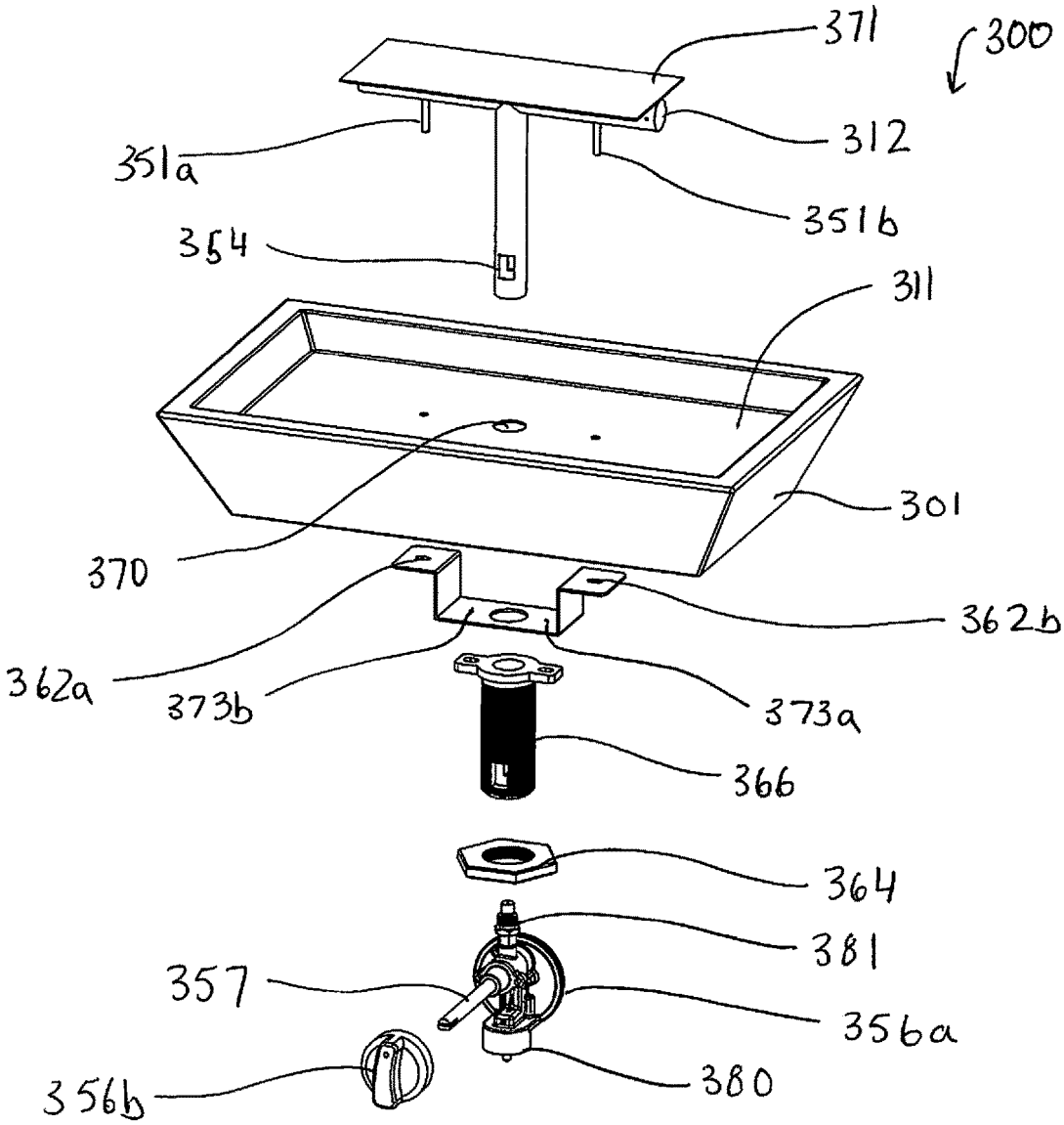
FIG. 34 is an exploded view of an alternative embodiment of the invention with fire receptacle 300.

FIGS. 34-48 depict an alternative embodiment of the invention having a unique gas system for connecting the fire receptacle 300 to a 1 lb propane gas bottle. FIG. 34 depicts fire receptacle 300 having an internal chamber 311 which houses a fuel dispersion assembly 312. The fuel dispersion assembly may be a metal pipe formed into a variety of different shapes, such as a straight line or rod, a ring or a square, for example. The fuel dispersion assembly includes a plurality of holes 319*a-c* which function to direct the fuel in the desired direction, which is preferably upwards or sideways such that the flame is directed away from nearby objects or persons situated around the receptacle. Shown in FIG. 34 is a fuel dispersion assembly in the form of a hollow and rigid rod. The fire receptacle 300 may be formed of steel or another appropriate material for housing fire, such as stone and/or aluminum.

The fuel dispersion assembly may include a plate 371 secured to its top surface which aids in deflecting the direction of the flame as gas travels out of the plurality of holes 319 *a-c*. Feet 351*a* and 351*b* are secured (for example, by welding) to the bottom surface of the fuel dispersion assembly 312 to provide the unit with stability within the internal chamber 311.

A retaining plate 363 is provided and includes a means for securing the plate to the bottom of the fire receptacle 300, such as screw type fasteners 361*a* and 361*b*, which are threaded through apertures, 362*a* and 362*b*. Secured to the retaining plate is rigid hollow tube 366 having threading on its outside surface which is secured to the retaining plate using one or more screws, shown as 374*a* and *b* which may be inserted into holes 373*a* and 373*b* of the retaining plate. The retaining plate also includes an opening 375 which is configured to align with the rigid hollow tube 366. The fire receptacle 300 includes an opening 370 which is configured to align with openings 375 and the opening formed within the rigid hollow tube 366 such that gas can flow through these pieces of the assembly. Welded to the fuel dispersion assembly 312 is venturi tube 350 having opening 354 to allow air to mix with fuel to provide an ideal flame after ignition. The venturi tube is configured to be inserted through opening 370, opening 375 and inside the opening created within the rigid hollow tube 366 such that the opening 354 of the venturi tube is aligned with the opening 365 of the rigid hollow tube 366. One or more openings may be provided in the venturi tube and the rigid hollow tube which may each be aligned together.

Figure 35:
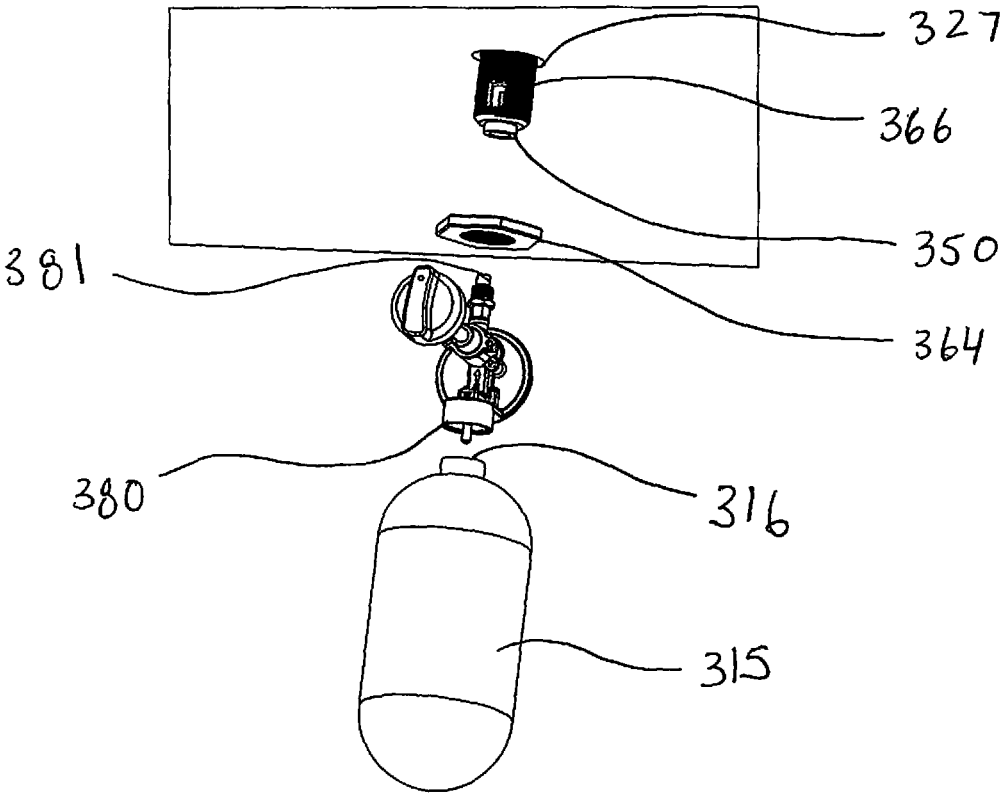
FIGS. 35 and 36 depict the method of inserting the fire receptacle 300 into a table having an opening and securing the fire receptacle to the table.
Figure 36:
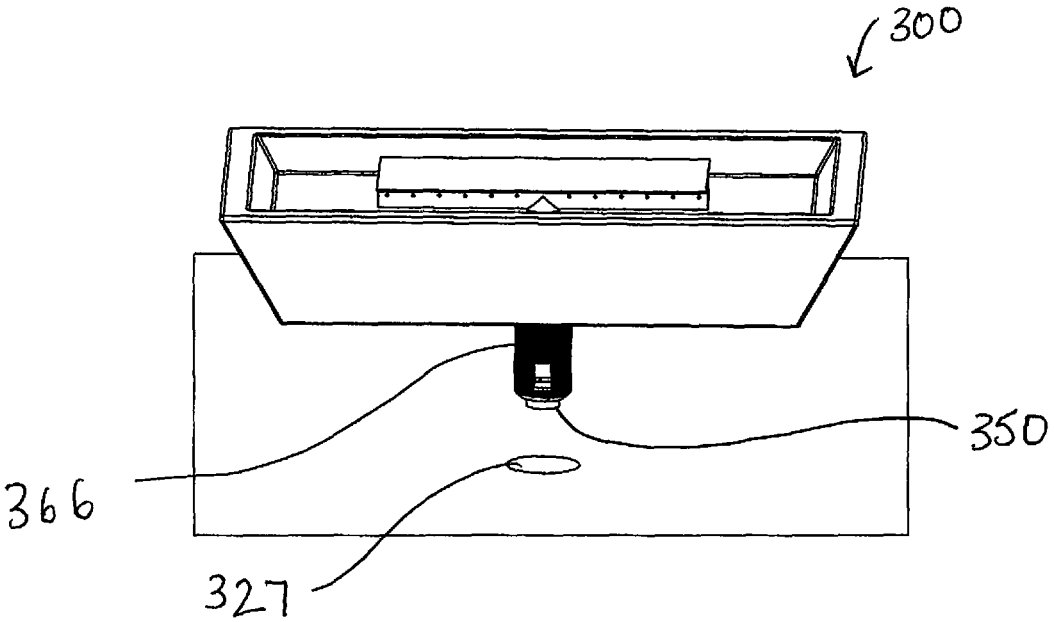
Figure 37:
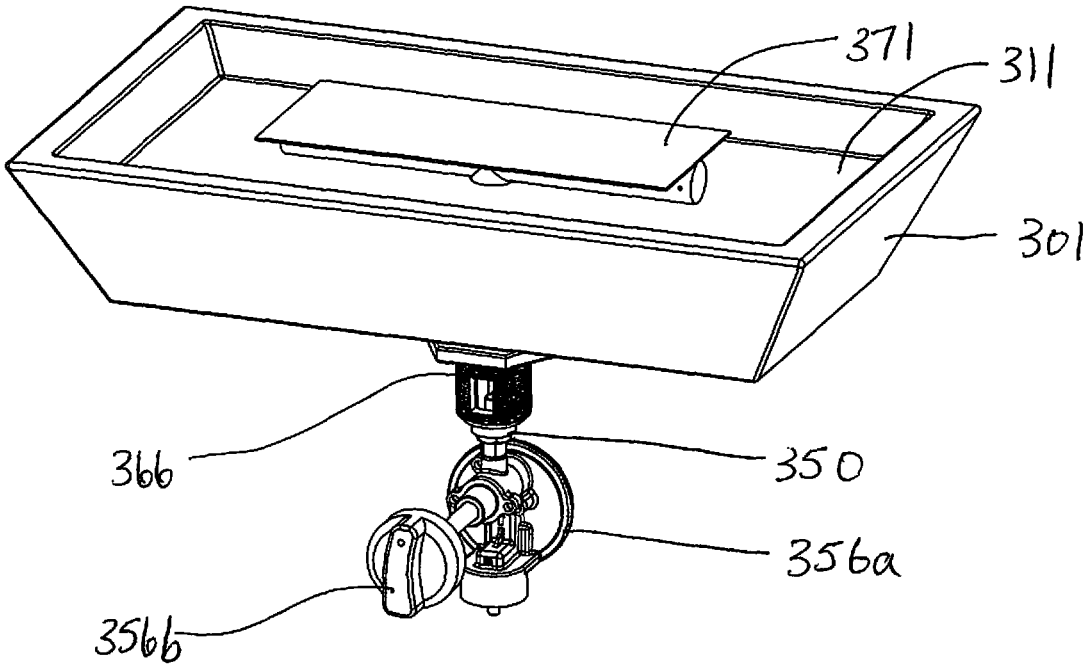
FIG. 37 is a perspective view of the fire receptacle 300.
Figure 38:
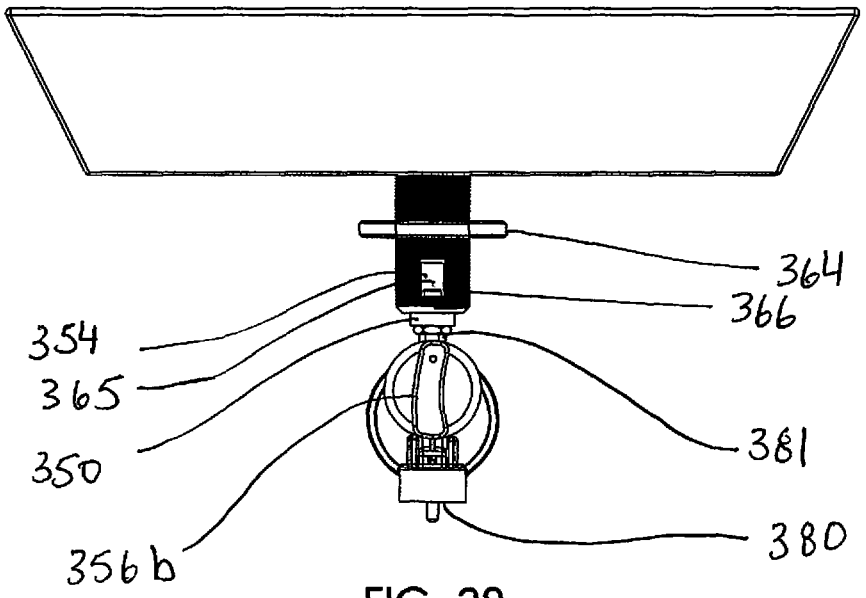
FIG. 38 is a front view of the fire receptacle 300.
Figure 39:
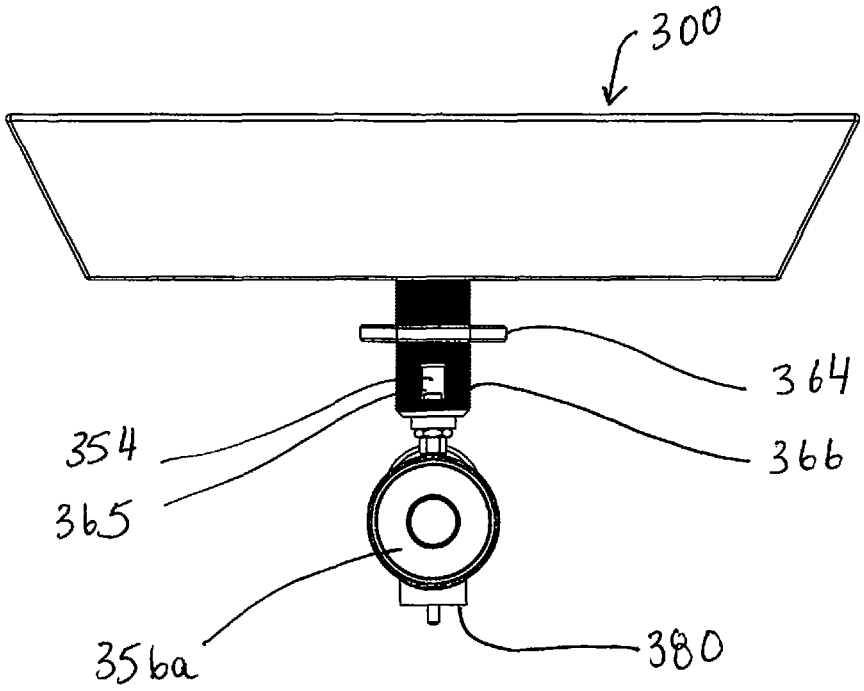
FIG. 39 is a back view of the fire receptacle 300.
Figure 40:
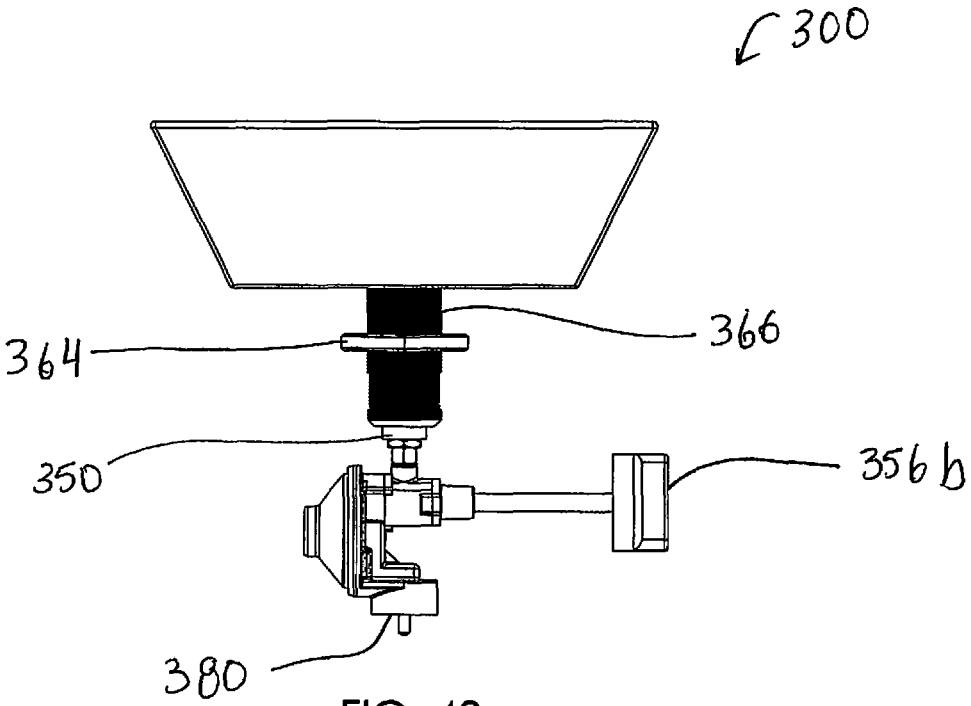
FIG. 40 is a left side view of the fire receptacle 300.
Figure 41:
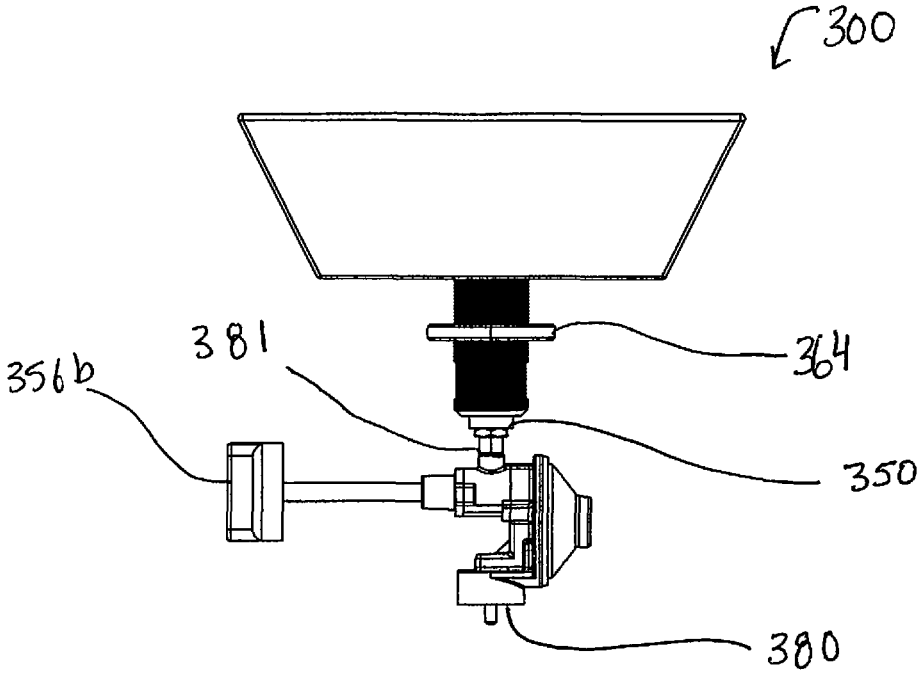
FIG. 41 is a right side view of the fire receptacle 300.
Figure 42:
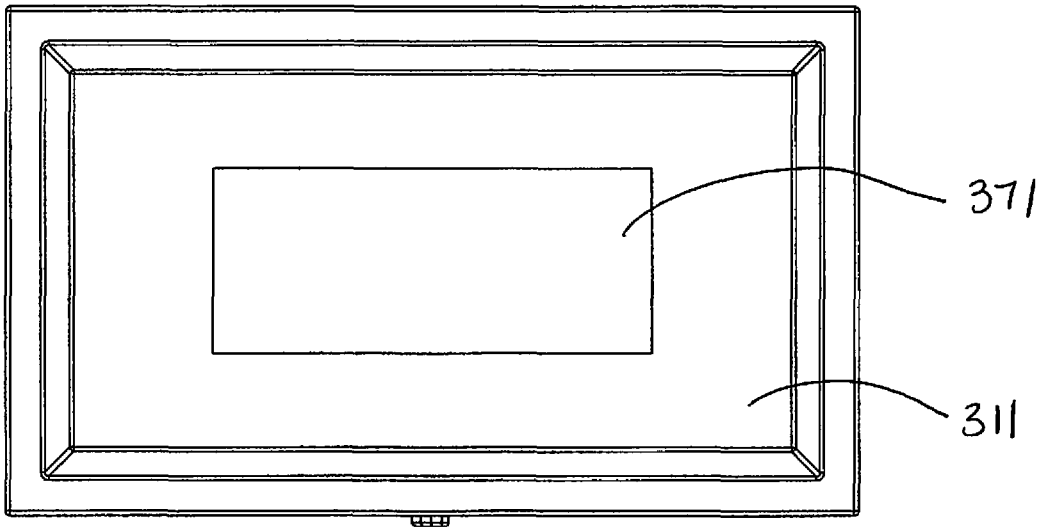
FIG. 42 is a top view of the fire receptacle 300.
Figure 43:
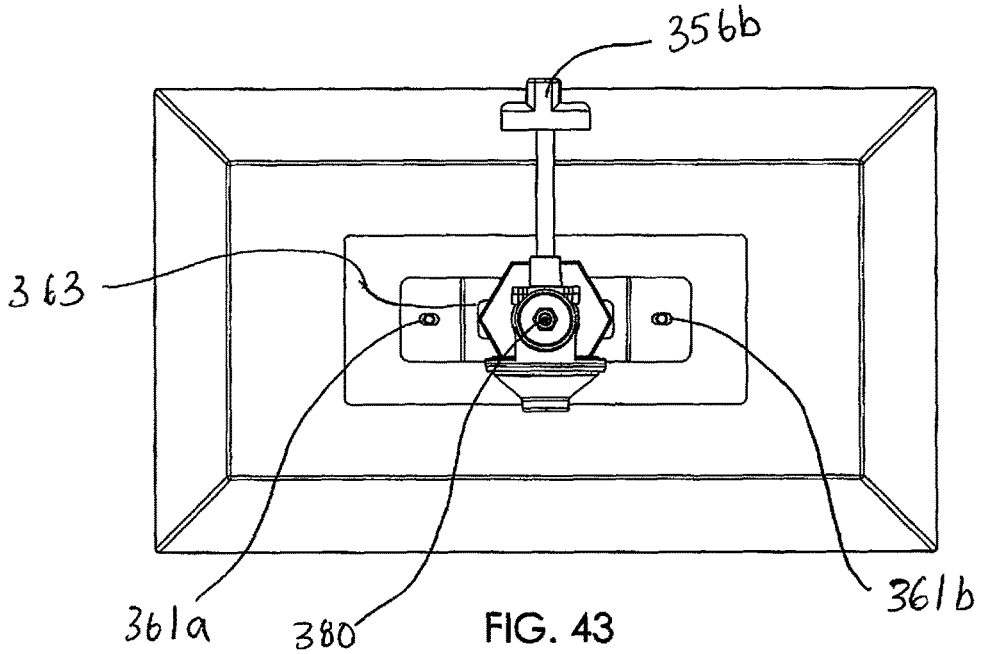
FIG. 43 is a bottom view of the fire receptacle 300.
Figure 44:
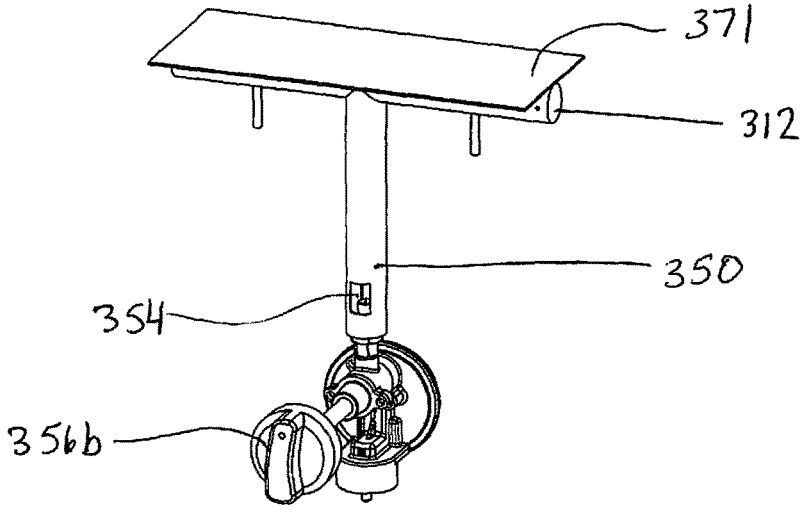
FIGS. 44-48 are several views of the interior components of the fire receptacle 300.
Figure 45:
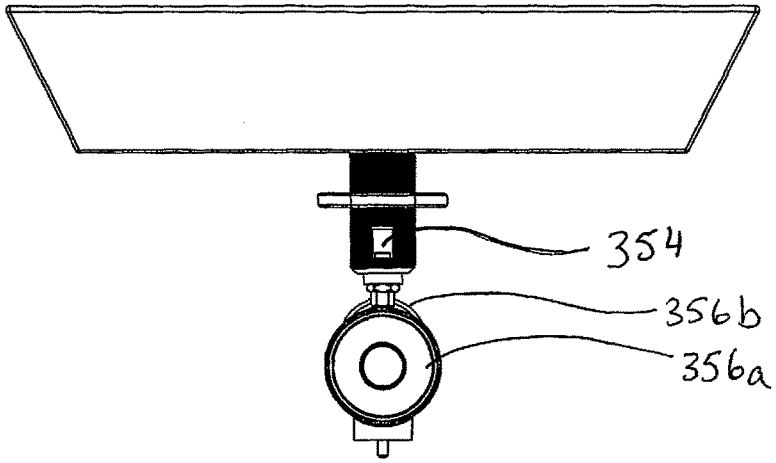
Figure 46:
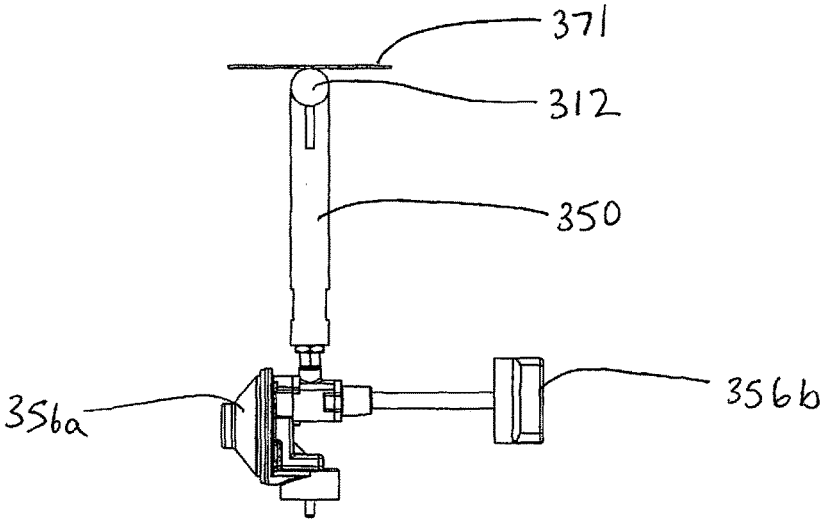
Figure 47:
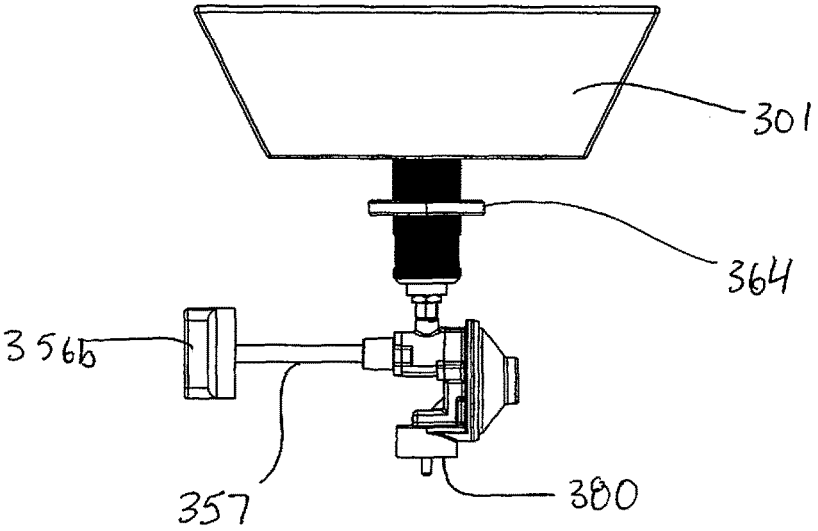
Figure 48:
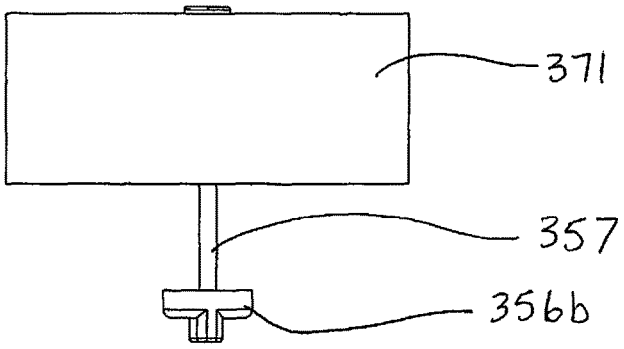

In use as shown in FIGS. 35 and 36, the fire receptacle 300 is pre-assembled such that the end of the venturi tube is inserted within the rigid hollow tube 366. The venturi tube/rigid hollow tube combination is inserted through the umbrella hole 327 of the table and secured to the table using mounting nut 364. The mounting nut 364 may be engaged around the threading of the outside surface of the rigid hollow tube 366. The gas valve 356*a* is provided and includes an inlet 380 and an outlet 381. The outlet of the gas valve is in removable connection with the venturi tube 350 and the inlet of the gas valve is in removable connection with the gas source, preferably a 1 lb propane bottle 315, which can be conveniently suspended underneath the table. Shown in FIG. 35 is propane bottle 315 having an outlet 316. The gas valve inlet 380 is configured to engage with propane bottle outlet 316 to create an airtight connection.

The gas valve 356*a* may be in the form of a ball valve, butterfly valve, gate valve, needle valve or other type of valve as is known in the art to precisely actuate gas flow control. The control knob 356*b* is attached to the gas valve 356*a* in a manner as is known in the art, such as by pressure fitting into the valve stem 357. When the control knob 356 is pushed in and turned towards the open position, the valve stem actuates the gas valve to allow the flow of gas to enter the venturi tube. A spark may then be provided by the user by igniting a match or lighter and holding it close to the one or more holes 319, for example, to produce a flame.

As explained earlier, the gas valve supplies and regulates the gas flow to the internal chamber 311. These valves may have a spring loaded locking feature designed to lock into place when the valve is in the OFF position. The valve may be depressed by pushing in the control knob while turning to the ON position.

While several particular forms of the invention have been illustrated and described, it will be apparent that various modifications and combinations of the invention detailed in the text and drawings can be made without departing from the spirit and scope of the invention. For example, references to materials of construction, methods of construction, specific dimensions, shapes, utilities or applications are also not intended to be limiting in any manner and other materials and dimensions could be substituted and remain within the spirit and scope of the invention. Accordingly, it is not intended that the invention be limited, except as by the appended claims.

What is claimed is:

1. A fire effect device comprising:

a container having a flat base and sidewalls extending upwards from the edges of the flat base, the sidewalls and flat base defining an internal chamber, and the flat base being configured to rest adjacent to a top surface of a table;

a fuel dispersion assembly disposed with the internal chamber, the fuel dispersion assembly comprising an inlet connected to a fuel pipe that extends through the flat base of the container;

a rigid, hollow tube mounted to the flat base and extending from the flat base, the rigid, hollow tube comprising external threads, accommodating the fuel pipe therein, and being configured to extend through an opening in the top surface of the table;

the fuel pipe comprising a valve having a control knob to control the flow of fuel through the fuel pipe to the fuel dispersion assembly, a first flexible fuel pipe extending from the inlet of the fuel dispersion assembly to the valve, and a second flexible fuel pipe extending from the valve through the rigid, hollow tube;

a nut comprising internal threads that is configured to connect to the external threads of the rigid, hollow tube and to tighten against an underside of the table to secure the fire effect device to the table, and a quick connect device disposed on an end of the second flexible fuel pipe, the quick connect device connecting the fire effect device to an external fuel source.

2. The fire effect device of claim 1, further comprising a mounting plate comprising a flat mounting end that is attached to the flat base, wherein the rigid, hollow tube is mounted to the flat base via the mounting pate and extends from the mounting plate.

3. The fire effect device of claim 1, wherein the control knob is disposed on one of the sidewalls.

4. The fire effect device of claim 1, wherein the rigid, hollow tube has a diameter from 1 in to 1.9 in.

5. The fire effect device of claim 1, further comprising sidewall extensions attached to tops of the sidewalls, the sidewall extensions comprising glass.

6. The fire effect device of claim 1, further comprising ventilation slots formed in the sidewalls.

7. The fire effect device of claim 1, wherein the rigid, hollow tube comprises at least one opening along a length of the rigid, hollow tube.

8. The fire effect device of claim 1, wherein the fuel dispersion assembly comprises one or more feet configured to mount the fuel dispersion assembly to the base plate within the internal chamber.

9. The fire effect device of claim 1, wherein the fuel dispersion assembly comprises a plate secured to its top surface which deflects a direction of flames as gas travels out of exit holes of the fuel dispersion assembly.

10. A method for attaching a fire effect device to a table having an umbrella hole opening, the method comprising:

providing a fire effect device comprising a container having a flat base and sidewalls extending upwards from edges of the flat base, the sidewalls and flat base defining an internal chamber;

a fuel dispersion assembly disposed within the internal chamber, the fuel dispersion assembly comprising an inlet connected to a fuel pipe that extends through the flat base of the container; and a rigid, hollow tube mounted to the flat base and extending from the flat base, the rigid, hollow tube comprising external threads and accommodating the fuel pipe therein, the fuel pipe comprising a valve having a control knob to control the flow of fuel through the fuel pipe to the fuel dispersion assembly, a first flexible fuel pipe extending from the inlet of the fuel dispersion assembly to the valve, a second flexible fuel pipe extending from the valve through the rigid, hollow tube; and a quick connect device disposed on an end of the second flexible fuel pipe;

resting the fire effect device on a top surface of the table with the flat base of the fire effect device adjacent to the top surface of the table and with the rigid, hollow tube extending through the umbrella hole opening;

tightening a nut comprising internal threads onto the external threads of the rigid, hollow tube against an underside of the table around the umbrella hole to secure the fire effect device to the table, and connecting the fire effect device to an external fuel source via the quick connect device.

11. The method of claim 10, wherein the fire effect device further comprises a mounting plate comprising a flat mounting end that is attached to the flat base, wherein the rigid, hollow tube is mounted to the flat base via the mounting plate and extends from the mounting plate.

12. The method of claim 10, wherein the control knob is disposed on one of the sidewalls.

13. The method of claim 10, wherein the rigid, hollow tube has a diameter from 1 in to 1.9 in.

14. The method of claim 10, further comprising attaching sidewall extensions to tops of the sidewalls, the sidewall extensions comprising glass.

15. The method of claim 10, further comprising ventilation slots formed in the sidewalls.

16. The method of claim 10, wherein the rigid, hollow tube comprises at least one opening along a length of the rigid, hollow tube.

* * * * *